US005086320A

United States Patent [19]

Koike

[11] Patent Number: 5,086,320

[45] Date of Patent: Feb. 4, 1992

[54] PAPER CONVEYING MECHANISM IN IMAGE FORMING APPARATUS

[75] Inventor: Tadao Koike, Tokyo, Japan

[73] Assignee: Ricoh Company, Ltd., Tokyo, Japan

[21] Appl. No.: 582,375

[22] Filed: Sep. 13, 1990

[30] Foreign Application Priority Data

| | | | |
|---|---|---|---|
| Sep. 14, 1989 | [JP] | Japan | 1-238567 |
| Nov. 17, 1989 | [JP] | Japan | 1-299189 |
| Nov. 17, 1989 | [JP] | Japan | 1-299190 |
| Nov. 17, 1989 | [JP] | Japan | 1-299191 |
| Jun. 29, 1990 | [JP] | Japan | 2-171827 |

[51] Int. Cl.[5] ..... G03G 21/00

[52] U.S. Cl. ..... 355/318; 271/176; 271/202; 271/270; 271/290; 355/308; 355/321

[58] Field of Search ..... 271/176, 270, 288, 289, 271/290, 202; 355/308, 309, 311, 316, 317, 318, 319, 321, 323

[56] References Cited

U.S. PATENT DOCUMENTS

| | | | |
|---|---|---|---|
| 4,506,873 | 3/1985 | Faltin | 271/270 X |
| 4,676,499 | 6/1987 | Kimizuka et al. | 271/202 X |
| 4,713,699 | 12/1987 | Nakamura et al. | 355/308 X |
| 4,780,745 | 10/1988 | Kodama | 271/270 X |
| 4,863,154 | 9/1989 | Hirakawa et al. | 271/176 |
| 4,935,786 | 6/1990 | Veeder | 355/319 |
| 4,954,849 | 9/1990 | Koike et al. | 355/319 |
| 4,975,749 | 12/1990 | Tsunoda et al. | 355/319 X |

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

A paper conveying mechanism in an image forming apparatus has an image forming body section of a manual operating type provided with a forward conveying path for conveying a discharged sheet of recording paper having an image thereon on front and rear sides of the image forming apparatus; an after-treatment device for after-treating the sheet of recording paper and arranged in parallel to a side portion of the image forming body section; a perpendicular conveying path for conveying the sheet of recording paper discharged from the forward conveying path in a direction approximately perpendicular to the forward conveying path, the perpendicular conveying path being connected to the forward conveying path such that the sheet of recording paper is fed to the after-treatment device; a paper feeder for feeding the sheet of recording paper in the forward conveying path; a paper feeder for feeding the sheet of recording paper in the perpendicular conveying path; and a common change-over mechanism additionally disposed in the paper feeders in the forward and perpendicular conveying paths and selectively switching a conveying operation of the sheet of recording paper and a stopping operation thereof. The other paper conveying mechanisms are also shown.

12 Claims, 20 Drawing Sheets

PAPER CONVEYING MECHANISM IN IMAGE FORMING APPARATUS

BACKGROUND OF THE INVENTION

1. Field of the Invention

The present invention relates to an image forming apparatus in which a finisher such as a sorter for after-treating a sheet of recording paper is additionally disposed in an image forming body section. More particularly, the present invention relates to a paper conveying mechanism for conveying the sheet of recording paper supplied to the image forming apparatus.

2. Description of the Related Art

As is well known, a finisher is additionally disposed in various kinds of image forming apparatuses such as a copying machine, a printer, a facsimile, etc. in a certain case. The finisher is composed of a sorter, etc. for sorting sheets of recording paper in an image forming body section.

In a general image forming body section, the sheets of recording paper are discharged and sorted in a side region of this body section. The general image forming apparatus is of such a side operating type in many cases.

Accordingly, the image forming body section has a conveying path for conveying the sheets of recording paper from one side portion to the other side portion so as to form an image. The above finisher is connected in parallel to an outlet portion of the above conveying path in the image forming body section, i.e., a side portion of the image forming body section.

However, in such an image forming apparatus, the image forming body section is of the side operating type as mentioned above so that a horizontal size of the entire apparatus is increased. Further, recorded sheets of recording paper having an image thereon are taken out of a tray and a paper supplying cassette having unrecorded sheets of recording paper therein is attached to the image forming body section on both sides of the image forming apparatus. Accordingly, it is necessary to dispose a space for performing the above-mentioned operations on both sides of the image forming apparatus.

It is further necessary to afford a margin of this space such that no pedestrian hits against the tray, etc. Accordingly, when the image forming apparatus is arranged, it is necessary to dispose a space having a size larger than that of a space required to perform the actual operation of the apparatus in consideration of the above-mentioned situations. Therefore, there is a case in which the various kinds of operations mentioned above cannot be sufficiently performed when such an image forming apparatus is arranged within a relatively small space.

To solve such problems, it is considered to arrange the above conveying path for the sheets of recording paper on front and rear sides of the image forming body section in a direction perpendicular to this conveying path. Such a structure is shown in e.g., Japanese Patent Application No. 1-150842 having the same applicant as this application.

However, in the image forming apparatus having the conveying path as mentioned above, for example, when the sheets of paper are continuously supplied, it is necessary that a subsequent sheet of recording paper does not interfere with a preceding sheet of recording paper when the conveying directions of the sheets of recording paper are switched. Therefore, the reduction of a moving speed of the continuously supplied sheets of paper is restrained by increasing a conveying distance between the sheets of recording paper or increasing the moving speed of the sheets when the sheets are conveyed in a perpendicular direction. However, in such a method, conveying distances are changed in accordance with kinds of the conveyed sheets of paper. Therefore, a control operation for switching the conveying speeds in accordance with the kinds of the conveyed sheets of paper is considerably complicated.

Further, the general image forming apparatus is set such that a sheet of recording paper having a maximal length can be conveyed, thereby causing the following problems.

Namely, copy modes are composed of modes of a single-sided copy, a two-sided (double-sided) copy and a synthetic copy on a single side in the above-mentioned image forming apparatus. The size of a member for conveying the sheets of recording paper is set in the image forming apparatus such that the sheets of recording paper corresponding to the respective copy modes can be sufficiently conveyed. Paper sizes generally used are composed of B4, A4 and B5 in many cases. A4 and B5 are often used for the two-sided copy.

The conveying path is set to convey the sheets of recording paper having a size larger than sizes having a high copy frequency. Accordingly, when such a conveying path is used to convey the sheets of recording paper of the sizes having a high copy frequency, a time from an image forming operation to the next image forming operation in the case of the two-sided copy is especially increased. Therefore, it takes much time to perform a copying operation, thereby reducing copying efficiency.

In a structure in which the sheets of recording paper are discharged onto an upper face of the image forming apparatus, there is a possibility that a base for arranging an original thereon overlaps a position for setting the original since this base is located on the upper face of the apparatus. Accordingly, it is difficult to perform the copying operation while the operation of the base and the original setting operation are separately performed.

It is further difficult to connect a sorter for sorting the discharged sheets of paper, a stapler or another peripheral device to a section for discharging the sheets of recording paper in consideration of their mutual arrangement relations.

Further, the sheets of recording paper are discharged in a state in which an image face is located on upper sides of the sheets of recording paper in many cases. The discharged sheets of paper are fed onto a tray in a page order opposite to that of the original. Accordingly, to obtain the copied sheets of paper in the page order, it is necessary to copy the original from the last page so that the copying operation is complicated. Further, in this case, when a two-sided copying operation is performed from a single-sided original composed of an odd number of sheets, a copied sheet of paper on a first page does not constitute a cover, but is a blank sheet of paper. Images of the original on first and subsequent pages are copied on second and subsequent sheets of paper so that the copying operation is performed in a page order opposite to that of the original.

SUMMARY OF THE INVENTION

It is therefore an object of the present invention to provide a paper conveying mechanism in an image forming apparatus in which the entire apparatus can be made compact and no large space for operating the apparatus is required and the apparatus can be disposed in a small space and sheets of recording paper can be efficiently conveyed at a high speed and can be discharged in a page order of an original.

The above object of the present invention can be achieved by a paper conveying mechanism in an image forming apparatus, comprising an image forming body section of a manual operating type provided with a forward conveying path for conveying a discharged sheet of recording paper having an image thereon on front and rear sides of the image forming apparatus; after-treatment means for after-treating the sheet of recording paper and arranged in parallel to a side portion of the image forming body section; a perpendicular conveying path for conveying the sheet of recording paper discharged from the forward conveying path in a direction approximately perpendicular to the forward conveying path, the perpendicular conveying path being connected to the forward conveying path such that the sheet of recording paper is fed to the after-treatment means; paper feeding means for feeding the sheet of recording paper in the forward conveying path; paper feeding means for feeding the sheet of recording paper in the perpendicular conveying path; and a common change-over mechanism additionally disposed in the paper feeding means in the forward and perpendicular conveying paths and selectively switching a conveying operation of the sheet of recording paper and a stopping operation thereof.

The above object of the present invention can be also achieved by a paper conveying mechanism in an image forming apparatus, comprising an image forming body section of a manual operating type provided with a forward conveying path for conveying a discharged sheet of recording paper on front and rear sides of the image forming apparatus at a predetermined feed speed, the sheet of recording paper having an image thereon formed at a predetermined image forming process speed; after-treatment means for after-treating the sheet of recording paper and arranged in parallel to a side portion of the image forming body section; a perpendicular conveying path for conveying the sheet of recording paper discharged from the forward conveying path in a direction approximately perpendicular to the forward conveying path, the perpendicular conveying path being connected to the forward conveying path such that the sheet of recording paper is fed to the after-treatment means; paper feeding means for feeding the sheet of recording paper in the forward conveying path; means for selecting either a paper conveying speed $V_1$ equal to the image forming process speed or a paper conveying speed $V_2$ set to be higher than the image forming process speed by providing a constant relation therebetween, the selecting means being disposed in the paper feeding means in the forward conveying path; and means for setting the paper conveying speed by using, as a reference, the sheet of recording paper having a largest value with respect to a difference $(h-i)$ between a width h of the sheet of recording paper with respect to a conveying direction thereof and a distance i between sheets of recording paper, the setting means being disposed in the paper feeding means in the forward conveying path.

The paper feeding means in the forward conveying path is constructed to set the paper conveying speed by a signal indicative of the detection of a rear end of the sheet of recording paper immediately after the sheet of recording paper has been discharged from a fixing device.

The paper feeding means in the forward conveying path is constructed to provide the paper conveying path $V_1$ and the paper conveying mechanism further comprises paper feeding means for feeding the sheet of recording paper in the perpendicular conveying path and providing the paper conveying speed $V_2$.

The paper feeding means in the forward conveying path is constructed to set the paper conveying speed every paper size on the basis of the width h and the distance i with respect to the sheet of recording paper.

The above object of the present invention can be also achieved by a paper conveying mechanism in an image forming apparatus, comprising a path for conveying and circulating a sheet of recording paper in a conveying direction set from a front side to a rear side with respect to an operation face of a copying machine; discharging ports for discharging the sheet of recording paper and respectively disposed on an upper side of the copying machine in the conveying-circulating path and on one side of the copying machine in a direction perpendicular to the conveying direction; a switch back conveying path for a small paper size located just behind the fixing device on a downstream side thereof in the conveying direction in the conveying-circulating path, the switch back conveying path for a small paper size being separated from the discharging port on the upper side of the copying machine and setting a conveying path toward a paper resupplying device for a two-sided copy; a switch back conveying path for a large paper size located on a downstream side of the switch back conveying path for a small paper size in the conveying-circulating path, the switch back conveying path for a large paper size being branched from a discharging path toward the discharging port on the upper side of the copying machine and setting a conveying path toward the paper resupplying device for a two-sided copy; a conveying path for a synthetic copy branched from the discharging path toward the discharging port on the upper side of the copying machine and setting a conveying path toward the paper resupplying device for a two-sided copy; and a perpendicular conveying path branched from the conveying paths set for the two-sided and synthetic copies with respect to the sheet of recording paper having the large size, the perpendicular conveying path changing the conveying direction of the sheet of recording paper in a direction perpendicular to this conveying direction in a position different from that of the paper resupplying device for a two-sided copy.

A conveying speed $V_1$ of the sheet of recording paper at the time of an image transfer processing on a photosensitive body for forming an image thereon in the conveying path from the front side to the rear side with respect to the operation face is set to be less than a conveying speed $V_2$ of the sheet of recording paper at the time of a copying processing except for the image transfer processing.

The above paper conveying mechanism further comprises a reverse receiving section located on an extension of the perpendicular conveying path and receiving the sheet of recording paper in a state in which the conveying direction of the sheet of recording paper conveyed from the perpendicular conveying path is changed to switch upper and lower sides of an image face on the received sheet of paper.

In the above-mentioned structure, the image forming body section is of a front operating type. Accordingly, a recorded sheet of paper having an image thereon is taken out of a tray and a paper supply cassette having unrecorded sheets of paper therein is attached to the image forming body section on the front side of the image forming apparatus. Thus, it is not necessary to dispose a space for operating the image forming apparatus and a space for a margin on both sides of the apparatus. Therefore, it is possible to dispose the image forming apparatus in proximity to wall faces on three sides of the apparatus except for the front side thereof. Further, the image forming apparatus can be made compact.

A finisher is disposed in parallel to a side of the image forming body section. The recorded sheet of paper is conveyed from the perpendicular conveying path of the image forming body section in a direction approximately perpendicular to a feeding direction of the forward conveying path. Thus, after-treatments such as a sorting operation of the sheet of recording paper are performed. The sheet of recording paper after such after-treatments is taken out of the image forming apparatus on the front side thereof. Accordingly, it is also unnecessary to dispose a space for operating the finisher and a space for a margin on both sides of the apparatus. Thus, it is possible to dispose the image forming apparatus in proximity to wall faces on three sides of the apparatus except for the front side thereof.

In the operation for discharging the sheet of paper in the perpendicular direction with respect to the finisher, the sheet of recording paper is conveyed from the forward conveying path to the perpendicular conveying path by a single change-over mechanism having a simplified structure. Thus, the conveying directions of the sheet of recording paper are reliably switched at a high speed.

Further, in the perpendicular discharging operation with respect to the finisher, a paper feed speed in the forward conveying path is determined such that the distance between preceding and subsequent sheets of recording paper in the forward conveying path is larger than a predetermined distance. Thus, a preceding transferred sheet of paper is fed to an inlet portion of the perpendicular conveying path. After the preceding transferred sheet of paper has been discharged from this inlet portion, a subsequent transferred sheet of paper is fed to the inlet portion of the perpendicular conveying path. Therefore, it is possible to reliably prevent the subsequent sheet of paper from overlapping the preceding sheet of paper in the inlet portion of the perpendicular conveying path, thereby preferably discharging the sheets of paper.

Further, in accordance with the present invention, when a two-sided copying operation is performed with respect to the sheet of recording paper having a small size, an image is fixed onto the sheet of recording paper and is immediately fed to the switch back conveying path for a small size in the conveying-circulating path. Thus, the sheet of recording paper is fed to the paper resupplying device for a two-sided copy.

Further, in accordance with the present invention, a time for conveying the sheet of recording paper except for a transfer time is reduced.

Further, in accordance with the present invention, it is possible to discharge the sheet of recording paper by switching front and rear sides of an image face. Accordingly, the sheet of paper can be arranged in a desirable page order.

Further objects and advantages of the present invention will be apparent from the following description of the preferred embodiments of the present invention as illustrated in the accompanying drawings.

DESCRIPTION OF THE PREFERRED EMBODIMENTS

Figure 1:
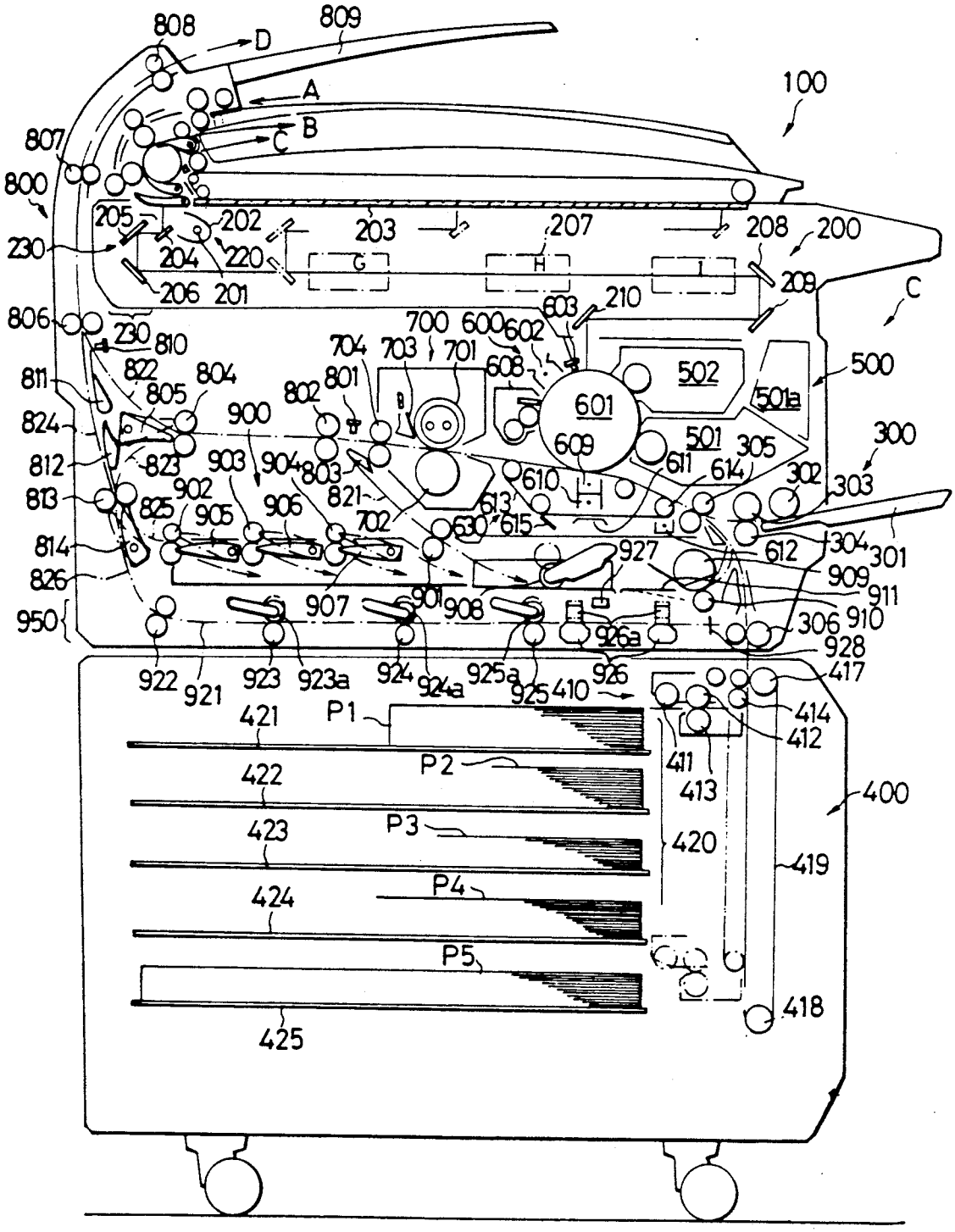
FIG. 1 is a typical arrangement view showing the entire construction of an image forming apparatus provided with a paper conveying mechanism in an embodiment of the present invention.

The preferred embodiments of a paper conveying mechanism in an image forming apparatus in the present invention will next be described in detail with reference to the accompanying drawings.

The structure and function of an image forming body section in an image forming apparatus in accordance with an embodiment of the present invention will be described in a copying machine shown in FIG. 1.

The image forming body section is constructed by a body C of the copying machine, a multi-stage paper feeder (PB) 400 arranged in a lower portion of this copying machine body C, and an automatic reverse document feeder (ARDF) 100 arranged in an upper portion of the copying machine body C.

In the copying machine body C, an original to be copied is inserted from a position shown by an arrow A and is stopped in a predetermined position on a contact glass 203. An operation for setting the original will be described in detail with reference to the automatic reverse document feeder (ARDF) described later.

An exposing processing is performed by an optical system 200. The optical system 200 is disposed under the contact glass 203 so as to scan an original image.

The optical system 200 is constructed by a light source 201 for illuminating the original, movable mirrors 204, 205, 206, a zoom lens 207, and stationary mirrors 208, 209, 210. The light source 201 for illuminating the original, a reflector 202, the movable mirror 204 constitute a first scanner 220. This first scanner 220 is moved in the right-hand direction in FIG. 1 at a speed V/m where V is a peripheral speed of a photosensitive body drum 601 and m is a copy magnification. Simultaneously, a second scanner 230 constructed by the movable mirrors 205 and 206 is moved in the right-hand direction in FIG. 1 at a speed V/2 m. The first scanner 220 and the second scanner 230 are moved by rotating an unillustrated drive motor. The peripheral speed of the photosensitive body drum 601 is constant irrespective of equal and variable magnifications.

The copy magnification is changed by changing the position of the zoom lens 207 in an optical path by driving an unillustrated lens drive motor. The copy magnification m is equal to 0.5 (50% in reduction), 1.0 (equal magnification) and 2.0 (200% in enlargement) when the zoom lens 207 is located in positions I, H and G in FIG. 1, respectively.

An image forming system 600 is disposed around the photosensitive body drum 601 on the right-hand side of the copying machine body C with respect to a central side thereof. The image forming system 600 is constructed by a charger 602 for uniformly charging the photosensitive body drum 601, an eraser 603 for erasing an unnecessary charge, and first and second developing devices 502 and 501 for developing an electrostatic latent image using toner powder and a magnetic brush. The image forming system 600 is also constructed by a belt transfer device 630 for transferring a toner image on the photosensitive body drum 601 onto a sheet of recording paper, a cleaner 608 for cleaning the image toner which is not transferred onto the sheet of recording paper and is left on the photosensitive body drum 601, etc.

The belt transfer device 630 presses an endless belt 613 wound around a plurality of rollers 614, etc. such that the endless belt 613 slightly comes in contact with the photosensitive body drum 601. The belt transfer device 630 performs a transfer corona discharging operation using a charger 609 from a rear face of the endless belt 613. A charger 612 charges the endless belt 613 to electrostatically absorb the sheet of recording paper. A charger 610 is used to discharge the endless belt 613. A rubber blade 615 is used to remove things left on the endless belt 613 and clean the endless belt 613 after the sheet of recording paper has been conveyed.

A section for feeding the sheet of recording paper is generally divided into two sections. One paper feeding section is constructed by a multiple manual paper feeder 300 attached onto the body side of the copying machine. The other paper feeding section is constructed by a multi-stage paper feeder (PB) 400 arranged under a bottom portion of the copying machine and provided with a plurality of paper feeding trays. A paper guide 301 of the multiple manual paper feeder 300 is normally closed and is opened when the paper guide is used as shown in FIG. 1, thereby setting sheets of recording paper.

The set sheets of recorder paper are picked up by a pick-up roller 302 one by one and one sheet of recording paper is fed by a paper feed roller 303 and a separation roller 304. The sheet of recording paper is stopped once by a pair of register rollers 305. Thereafter, the sheet of recording paper is fed in synchronization with a front end of an image on the photosensitive body drum 601 along a conveying direction set from a front side of an operation section on the right-hand side in FIG. 1 onto a rear side of the operation section on the left-hand side in FIG. 1. In this case, a conveying speed of the sheet of recording paper is V1 when a transfer processing is executed, and is V2 when a processing except for this transfer processing is executed. The speed V1 is set to be less than the speed V2 ($V1<V2$) so as to reduce a conveying time.

In a paper feeding operation of the above multi-stage paper feeder 400, a paper feeder 410 is first raised and lowered toward a paper tray for supplying selected sheets of recording paper. When the paper feeder 410 is moved to the paper tray for selected sheets of recording paper, the raising and lowering movements of the paper feeder 410 are stopped by receiving a signal from an unillustrated sensor. Subsequently, the paper tray is moved onto the side of the paper feeder. A paper feeding system is basically similar to that in the multiple manual paper feeder.

Namely, sheets of paper are fed by a pick-up roller 411 to a paper feed roller 412 and are separated from each other by the paper feed roller 412 and a separation roller 413. Each of separated sheets of paper is fed from the rollers 412 and 413 to a conveyer roller 306 by a conveying belt 419 provided with e.g., a sucking mechanism.

The movement of the fed sheet of paper is stopped when this sheet has reached a pair of register rollers 305 through the conveyor roller 306. Then, the sheet of paper is held by the endless belt 613 through the pair of register rollers 305 and a toner image is transferred onto this sheet of paper. The toner image is heated, melted and fixed onto the sheet of paper by a pair of thermal rollers composed of a fixing roller 701 and a pressing roller 702. Thereafter, the sheet of recording paper after such a fixing operation (which is called a transferred sheet of paper) has passed through a pair of fixing-discharging rollers 704 in a conveying path along the above-mentioned conveying direction. The transferred sheet of paper is then fed to a paper discharging tray 809 located on an upper face of the body of the copying machine, a paper resupplying device 900 or a sorter conveying section 950 through a conveying path 822 set toward the paper discharging tray 809.

A sensor 801 for detecting a rear end of the transferred sheet of paper is arranged just behind the pair of fixing-discharging rollers 704. A conveying path 821 is disposed on a downstream side of this sensor 801 and is branched by a guide gate claw 803 from a conveying path formed by rollers 802 and 804. The conveying path 821 feeds the transferred sheet of paper toward the paper resupplying device 900 for a two-sided (double-sided) copy described later and constitutes a switch back conveying path for a small size. This switch back conveying path 821 is a conveying path used to perform a two-sided copying operation described later with respect to the transferred sheet of paper of a size equal to or less than A4.

A sensor 810 for detecting a rear end of the transferred sheet of paper is arranged backward from the above switch back conveying path 821 for a small size. Namely, the sensor 810 is arranged on a downstream side of the switch back conveying path 821 in the conveying direction of the sheet of recording paper. The sensor 810 is disposed in the conveying path toward the paper discharging tray 809 located on the upper face of the copying machine. A pair of rollers 806 are arranged on a downstream side of this sensor 810 and can be rotated in normal and reverse directions. A conveying path 824 is branched by the pair of rollers 806 and a guide gate claw 811 from the conveying path formed by the rollers 802 and 804. The conveying path 824 feeds the transferred sheet of paper toward the paper resupplying device 900 for a two-sided copy described later and constitutes a switch back conveying path for a larger size.

When the two-sided copying operation is performed, two conveying paths different from each other are generally used in accordance with a size equal to or less than A4 (or LT) and a size except for the former size.

In the case of the size equal to or less than A4 (or LT), when the rear end of the transferred sheet of paper passes through the fixing device 700, the pair of rollers 802 receive a signal from the sensor 801 and are rotated in reverse rotations immediately after the transferred sheet of paper has passed through the gate claw 803. Thus, the transferred sheet of paper is fed to the conveying path 821. After the transferred sheet of paper passes through a pair of rollers 901, a pick-up roller 908 is lowered and rotated so that the transferred sheet of paper is fed until a position just below a paper feed roller 909. A pressing plate 911 is located downward for a time except for the paper supplying time. When the sheet of paper is supplied, the pressing plate 911 is raised and a pressure for supplying the sheet of paper is applied to the paper feed roller 909. A separation roller 910 is rotated in the counterclockwise direction when torque applied to this roller is less than a predetermined value. When the torque greater than this predetermined value is applied to the separation roller 910, this separation roller is rotated together with the paper feed roller 909 so that the transferred sheet of paper is supplied one by one. The transferred sheet of paper thus resupplied is fed until the transferred sheet of paper is slackened by a predetermined amount using the pair of register rollers 305. Thereafter, the transferred sheet of paper is stopped and is restarted in synchronization with a front end of the image on the photosensitive body. The subsequent processings are similar to those in the case of the single-sided copy.

Accordingly, the sheet of recording paper having a small size equal to or less than A4 is fed to the switch back conveying path 821 for a small size. Thus, this sheet of recording paper is fed to the paper resupplying device 900 for a two-sided copy without using the conveying path for a sheet of recording paper having a size greater than the small size. Accordingly, it is possible to reduce a time for supplying the sheet of paper in the two-sided copy since a paper conveying speed is high in a process except for the transfer process.

In the case of a paper size greater than A4 (or LT), the transferred sheet of paper passes through the guide gate claw 803 toward the fixing device and the switch back conveying path for a small size. Thereafter, the transferred sheet of paper is fed to the gate claw 811 through the rollers 802 and 804. When a rear end of the transferred sheet of paper is detected by the sensor 810, the pair of rollers 806 are rotated in the reverse directions. The transferred sheet of paper is then fed to the switch back conveying path 824 for a large size for conveying the transferred sheet of paper toward the above paper resupplying device 900 for a two-sided copy and a perpendicular conveying path described later. At this time, a gate claw 814 is displaced to a position shown by a broken line so that the transferred sheet of paper is fed to a pair of rollers 902.

When the size of the transferred sheet of paper is A3 (or 17"), a gate claw 905 is located in a position shown by a broken line in FIG. 1. Therefore, the transferred sheet of paper is discharged onto the paper resupplying device immediately after this transferred sheet has passed through the pair of rollers 902. When the size of the transferred sheet of paper is B4 (or 14"), the gate claw 905 is located in a position shown by a solid line and a gate claw 906 is located in a position shown by a broken line in FIG. 1. Therefore, the transferred sheet of paper passing through the pair of rollers 903 is discharged onto the paper resupplying device. When a longitudinal size of the transferred sheet of paper is that of each of A4 and B5 (or 11"), the gate claws 905 and 906 are located in positions shown by solid lines and a gate claw 907 is located in a position shown by a broken line in FIG. 1. Therefore, the transferred sheet of paper passing through a pair of rollers 904 is discharged onto the paper resupplying device. The subsequent operations are similar to those in the above-mentioned case of the paper size equal to or less than A4.

A synthesis conveying path for performing a synthetic or multiplex copying operation on a single side of the transferred sheet of paper is disposed within the above copying machine body C in addition to the above conveying path set for the two-sided copy.

Namely, the above conveying path for a synthetic copy is set from a gate claw 805 located on the downstream side of the pair of rollers 804 to the paper resupplying device 900 for a two-sided copy.

When the synthetic copying operation is performed, the gate claw 805 is displaced to a position shown by a broken line in the conveying path for a synthetic copy irrespective of the size of the transferred sheet of paper. Thus, the transferred sheet of paper after the fixing operation thereof is fed to a conveying path 823. Next, the gate claw 814 is displaced to a position shown by a broken line in FIG. 1 so that the transferred sheet of paper is fed to the pair of rollers 902. When the size of the transferred sheet of paper is A3 (or 17"), the gate claw 905 is located in the position shown by the broken line. Therefore, the transferred sheet of paper is discharged onto the paper resupplying device immediately after this transferred sheet has passed through the pair of rollers 902. When the size of the transferred sheet of paper is B4 (or 14"), the gate claw 905 is located in the position shown by the solid line and the gate claw 906 is located in the position shown by the broken line. Therefore, the transferred sheet of paper is discharged onto the paper resupplying device after this transferred sheet has passed through the pair of rollers 903. When the longitudinal size of the transferred sheet of paper is that of each of A4 and B5 (or 11"), the gate claws 905 and 906 are located in the positions shown by the solid lines and the gate claw 907 is located in the position shown by the broken line. Therefore, the transferred sheet of paper is discharged onto the paper resupplying device after this transferred sheet has passed through the pair of rollers 904.

The above-mentioned operations are similar to those in the above case of the two-sided copy with respect to the sheet of paper having a size larger than A4 (or LT). When a transversal size of the transferred sheet of paper is that of A4 (or equal to or less than that of LT), the gate claws 905, 906 and 907 are located in the positions shown by the solid lines. Therefore, the transferred sheet of paper is discharged onto the paper resupplying device after this transferred sheet has been moved on the gate claw 907. The pick-up roller 908 is then operated to align the discharged sheets of paper with each other. The subsequent operations are similar to those at the time of the two-sided copy mentioned above.

Figure 2:
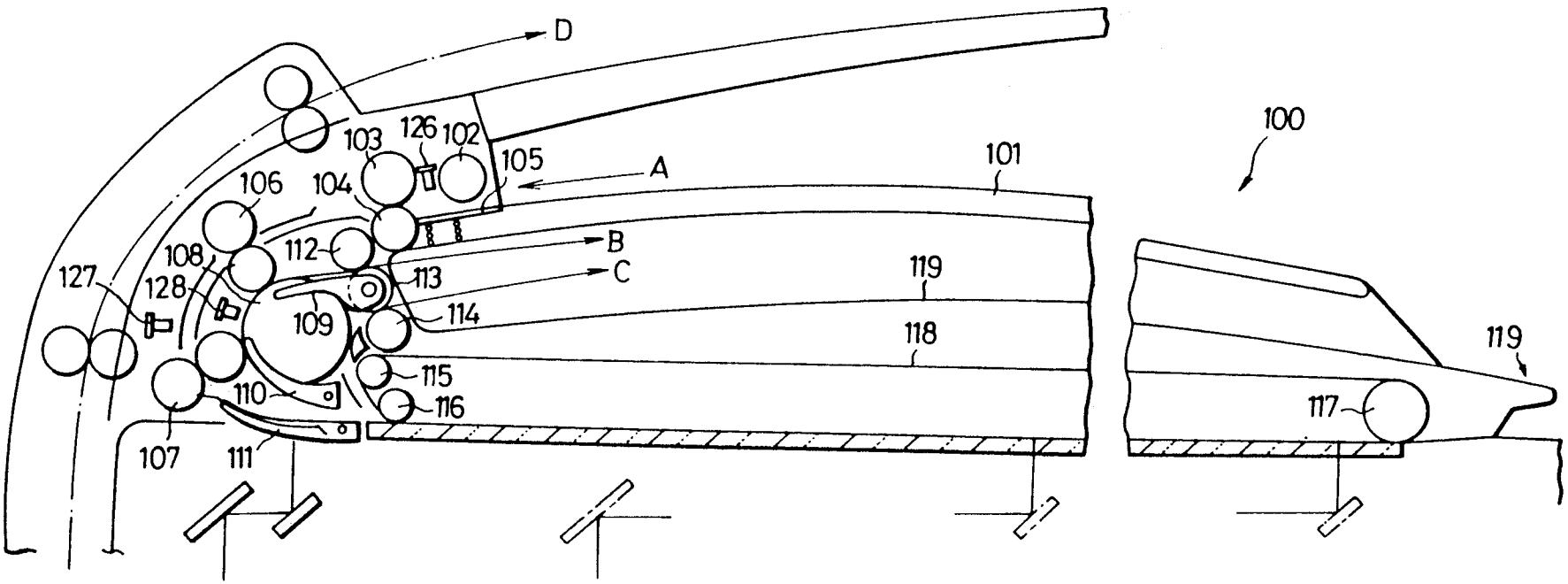
FIG. 2 is an enlarged side view of an automatic reverse document feeder used in the image forming apparatus shown in FIG. 1.

The construction and operation of the automatic reverse document feeder (ARDF) 100 will next be described with reference to FIGS. 2 and 3.

In the case of a single-sided original, the original to be copied is set on a tray 101 in the direction of arrow A such that an image face constructs an upper face of the original. The set original is fed by a paper feeding mechanism similar to the multiple manual paper feeder.

The original is fed by a pick-up roller 102 in the left-hand direction. Thus, only an uppermost sheet of the original is fed toward a pair of rollers 106 by a paper feed roller 103 and a separation roller 104 rotated in the clockwise direction.

This automatic document feeder feeds the sheet of the original in a page order. The pair of rollers 106 are stopped until the sheet of the original is fed to these rollers. The pair of rollers 106 begin to be rotated after a short time since a front end portion of the sheet of the original has reached these rollers, thereby correcting a skew of the original.

When the original passes through a pair of rollers 107, the original is guided by a guide plate 123 and is fed between the contact glass 203 and a conveyer belt 118. The conveyer belt 118 is wound around a drive roller 115, a roller 116 and a tension roller 117. A stopping position of the original on the contact glass 203 is determined by the number of pulses counted from a start point at which a rear end of the original has passed through a sensor 127.

When a scanning operation with respect to the original is completed, the conveyer belt drive roller 115 is rotated in the clockwise direction so that the original is fed in the left-hand direction in a switch back operation. A first gate claw 111 is first located in a position shown by a solid line in FIG. 3*a*. The position of this first gate claw 111 is then changed to a position shown by a broken line in FIG. 3*a*. Namely, the first gate claw 111 is located in a position shown by a solid line in FIG. 3*c*. The front end of the original is fed between rollers 112 and 113 and is then discharged onto a tray 119.

Figure 3A:
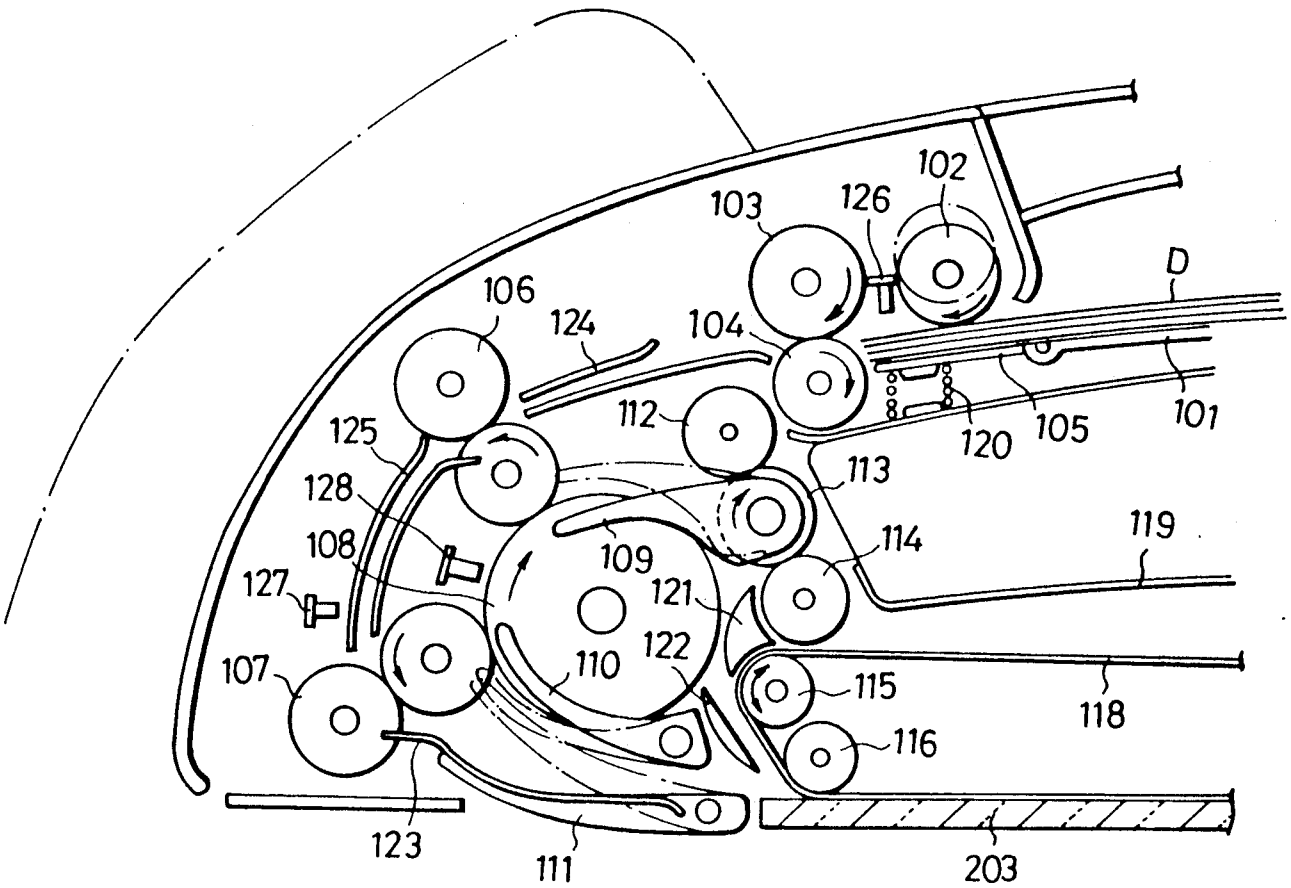
FIGS. 3*a*, 3*b*, 3*c* and 3*d* are partially enlarged side views for explaining the constructions and operations of an original feeding section, a reverse section and an original conveying section in the automatic reverse document feeder.
Figure 3B:
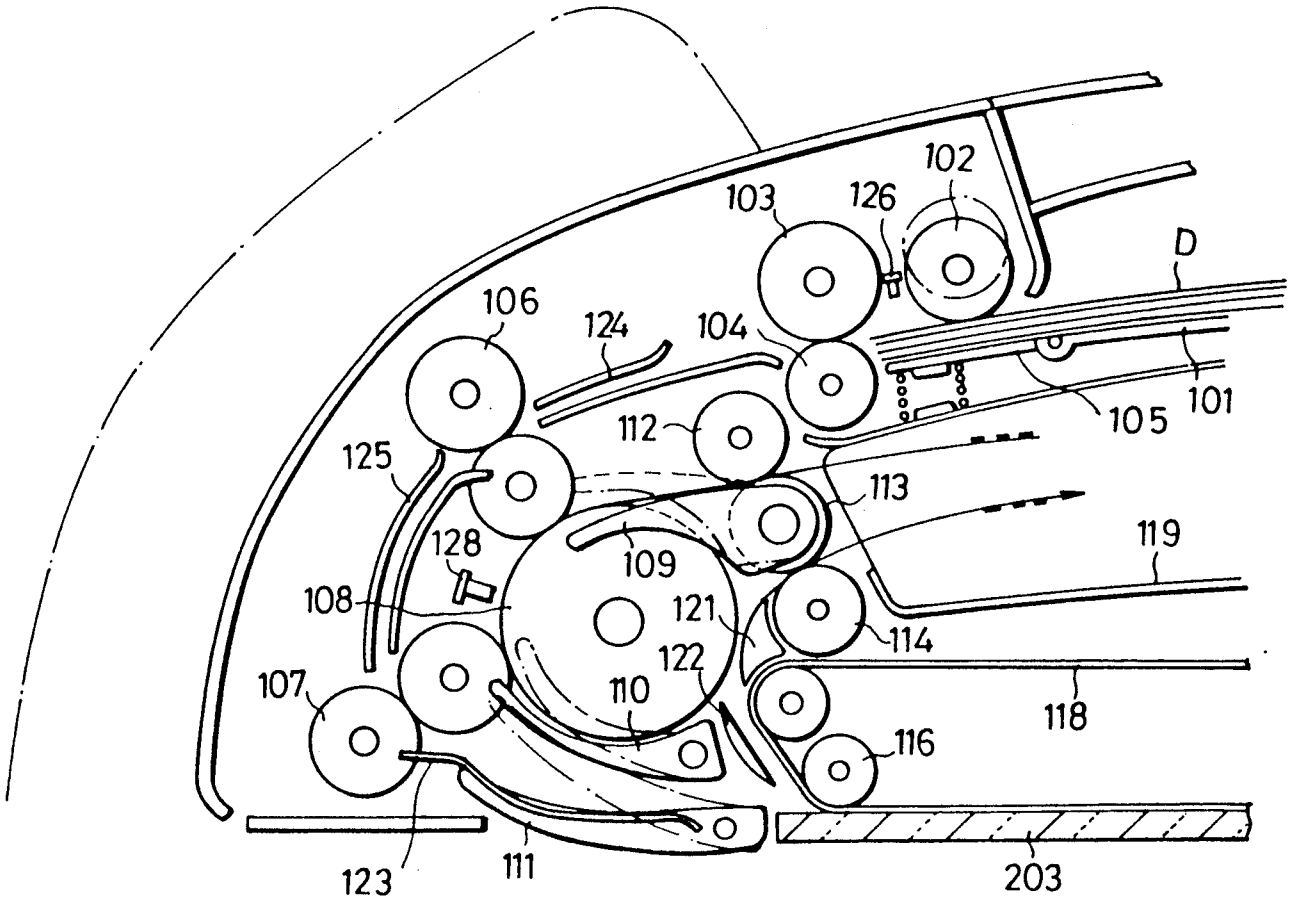
Figure 3C:
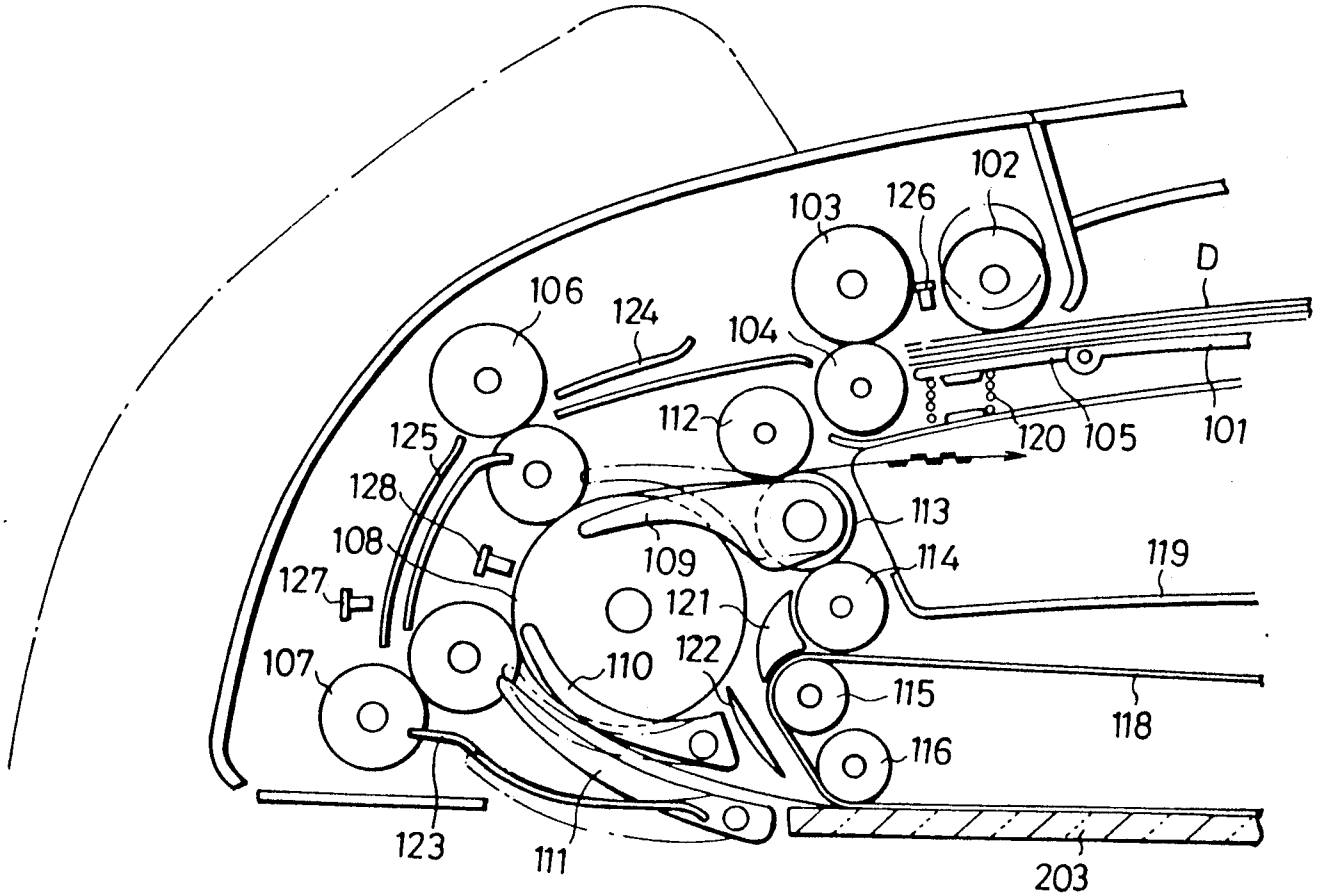

In this state, the image face of the original constructs the upper face thereof. Therefore, when the sheets of the original are continuously discharged in this way, a page order of the discharged sheets is reverse to that of the original. To avoid such a situation, the original is again turned upside down in this automatic document feeder. Namely, when the rear end of the original is detected by a sensor 128, rollers 108 and 113 are simultaneously rotated in the counterclockwise direction. Simultaneously, the position of a second gate claw 110 is switched to a position shown by a solid line in FIG. 3*b* on the basis of an inverted signal indicative of the counterclockwise direction of the rollers 108 and 113. The position of the first gate claw 111 is also changed to a lower position shown by a solid line in FIG. 3*b*. As shown in FIG. 3*c*, the original is thus fed between the roller 113 and a roller 114 and is stacked on the tray 119 in a state in which the image face of the original constructs a lower face thereof. The above-mentioned operations are similarly performed repeatedly so that the sheets of the original are stacked with each other in the same page order as that in the first setting state of the original.

In the case of a two-sided original, the operation of the automatic document feeder is similar to that in the case of the above single-sided original until a first original face is stopped on the contact glass 203. When the scanning operation with respect to the original is completed, the conveyer belt drive roller 115 is rotated in the clockwise direction so that the original is fed in the left-hand direction in a switch back operation. At this time, similar to the case of the single-sided original, the first gate claw 111 is displaced upward and the position of a third gate claw 109 is also changed to an upper position thereof. Such a state is shown in FIG. 3*d*.

Figure 3D:
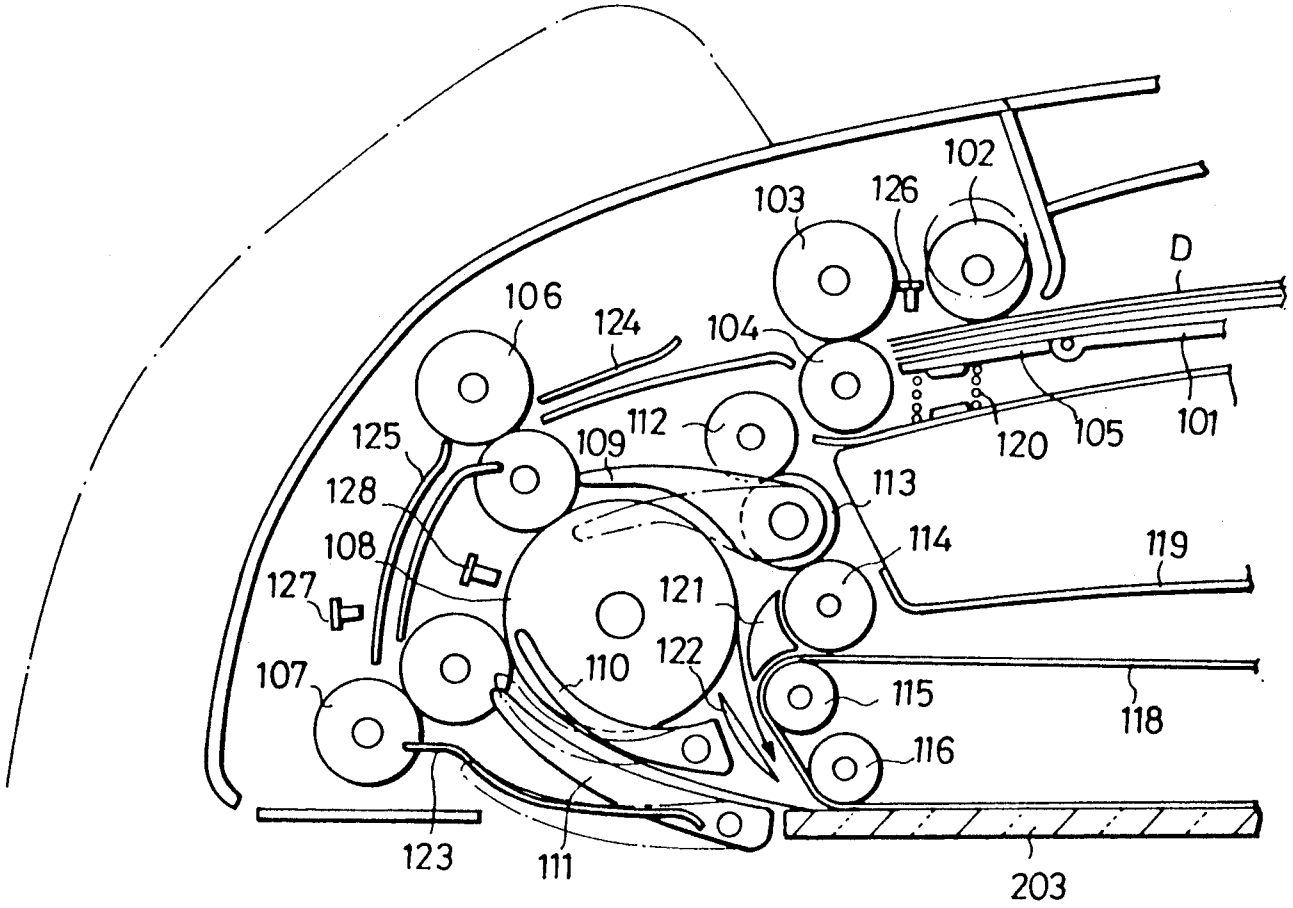

In FIG. 3*d*, a front end of the original turned upside down is guided by guides 121 and 122 and is fed onto the contact glass 203 again. A stopping position of the original on the contact glass 203 is determined by the number of pulses counted from a start point at which a rear end of the original has passed through a sensor 38.

When the scanning operation with respect to a second face of the original is completed, the conveyer belt drive roller 115 is rotated in the clockwise direction so that the original is fed in the left-hand direction in a switch back operation. At this time, the third gate claw 109 is displaced downward and the sheets of the original are fed between the rollers 112 and 113 and are stacked with each other on the tray 119 as shown in FIG. 3*c*. Thus, the operations for feeding and discharging the two-sided original have been completed. The above-mentioned operations are similarly performed repeatedly so that the sheets of the original are stacked with each other in the same page order as that in the first setting state of the original.

Figure 4:
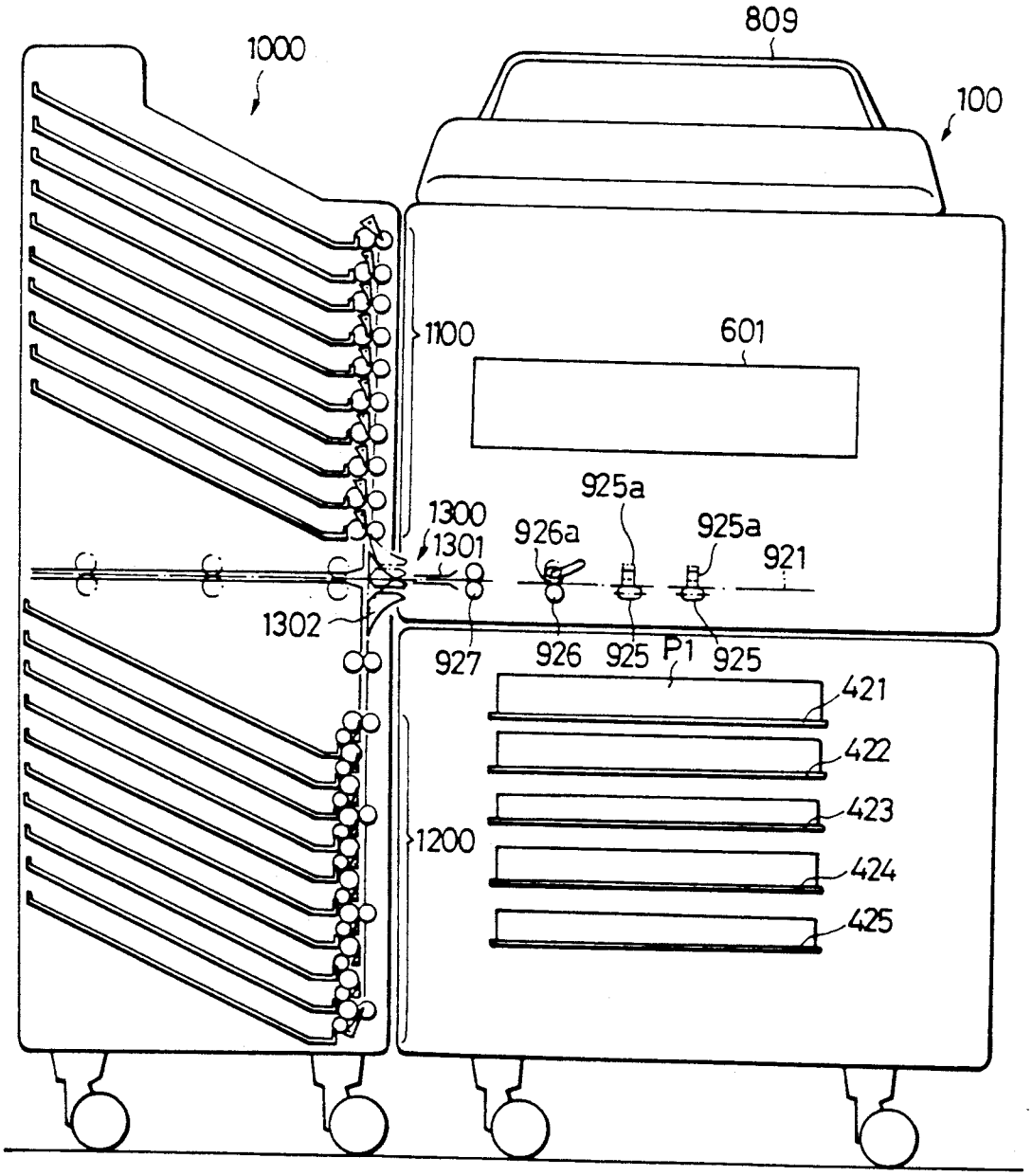
FIG. 4 is a schematic front view for explaining a state in which a sorter is additionally disposed in the image forming apparatus shown in FIG. 1.

As shown in FIG. 4, a sorter 1000 is arranged on a side of the above image forming body section.

In this sorter 1000, sheets of recording paper are fed from the paper resupplying device for a two-sided copy constituting a conveying path for forming an image in the image forming body section in a direction approximately perpendicular to the conveying direction of the paper resupplying device. Namely, a discharge conveying path for sorting transferred sheets of paper described later is disposed within the paper resupplying device 900 of the image forming body shown in FIG. 1. This discharge conveying path is disposed to convey the transferred sheets of paper aligned with each other on the front side of an operation section (the right-hand side) in FIG. 1 in a state in which a conveying direction of the transferred sheets of paper is changed by 90°. In accordance with such a structure, conveying efficiency is improved since the sheets of paper having a large size such as A3, B4 and fed in a longitudinal direction thereof are conveyed in a transversal direction of the sheets.

This sorter 1000 can switch front and rear faces of the discharged and transferred sheets of paper, i.e., the upper and lower sides of an image face immediately after the image has been completely formed. The sorter 1000 is operated as follows when the above switching operation is not performed.

Namely, when the copying operation is performed in a page order, copied sheets of paper must be stacked with each other in a state in which the image face constitutes a lower face of each of the copied sheets. When the image face constitutes an upper face of each of the copied sheets, a subsequent copied sheet of paper must be inserted onto a lower side of a preceding copied sheet of paper so as to hold the same page order as the original. In the latter case, the structure of the sorter is not simple so that the method for inserting the subsequent copied sheet onto the lower side of the preceding copied sheet is not general. Accordingly, the former case is a general case and is therefore called a rear face paper discharging case in the following description.

An operation for turning an upper face of each of the transferred sheets of paper upside down is performed on the image forming body side shown in FIG. 1 in the above rear face paper discharging case. Namely, similar to the case of the synthetic copy, the transferred sheets of paper are fed to a pair of rollers 922 through conveying paths 823 and 826 by switching the position of the gate claw 805 to the position shown by the broken line in FIG. 1. As shown in FIG. 1, the transferred sheets of paper are fed along a sorter conveying path 921 by longitudinal conveying rollers 923, 924 and 925 as a forward conveying roller in a state in which the image face constitutes a lower face of each of the sheets of paper. At this time, a pinch roller 926*a* as a press-contact roller constituting a perpendicular conveying roller 926 is separated upward and escaped from the sorter conveying path 921.

A paper detecting sensor 927 detects a front end of each of the transferred sheets of paper discharged from the roller 925. The transferred sheet of paper is then fed for a constant time and is stopped. Subsequently, pinch rollers 923*a*, 924*a* and 925*a* as a press-contact roller constituting the longitudinal conveying rollers 923, 924 and 925 are respectively separated upward and escaped from the sorter conveying path 921. Then, the pinch roller 926*a* of the perpendicular conveying roller 926 is lowered and supports and conveys the transferred sheet of paper on the front side of the image forming apparatus in FIG. 1.

Figure 5:
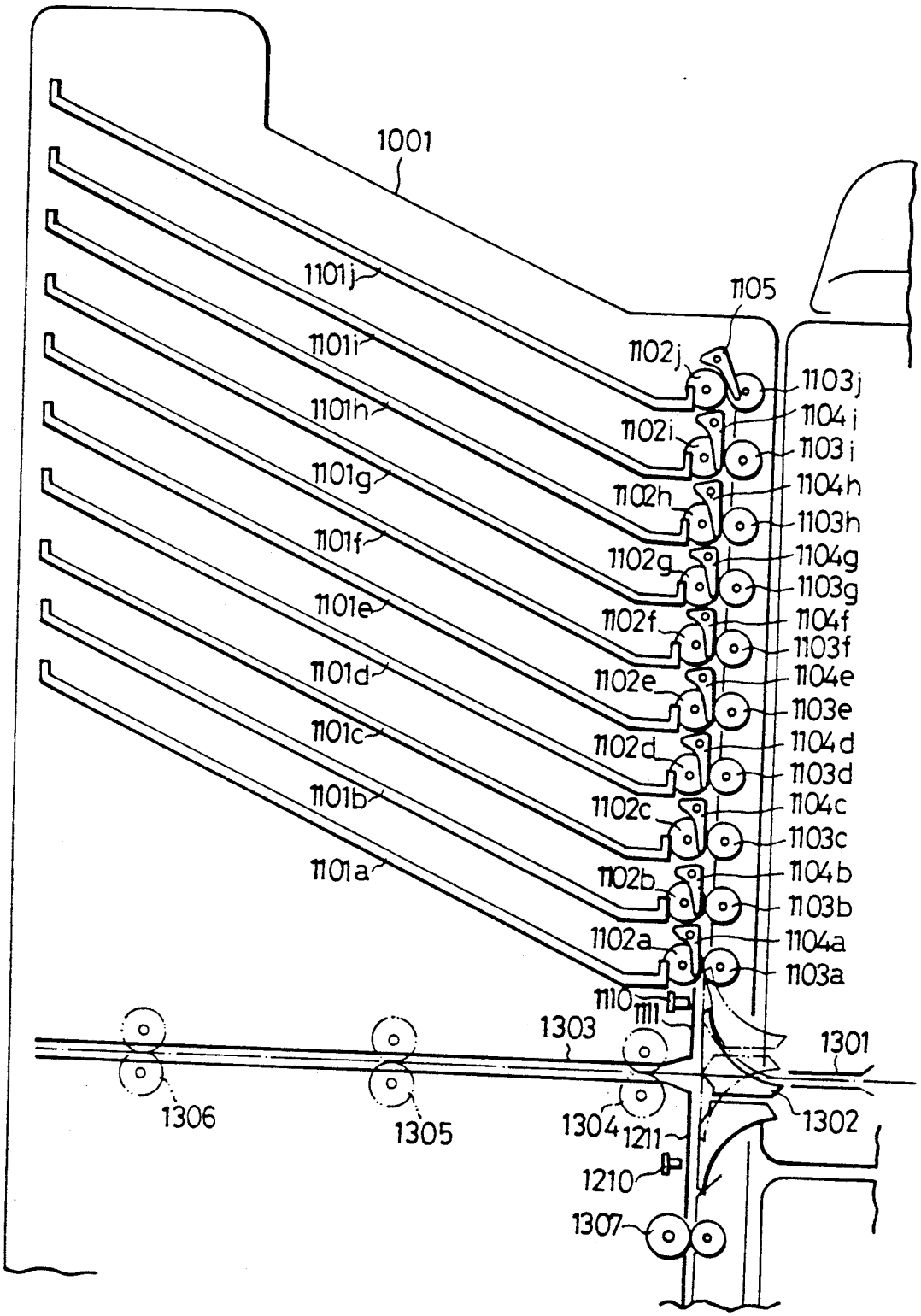
FIG. 5 is an enlarged front view for explaining the construction and operation of a bin sorter arranged in an upper portion of the sorter.

As shown in FIG. 4, the transferred sheet of paper discharged from the image forming body passes through a guide plate 1301 and is guided upward by a gate claw 1302. Further, as shown in FIG. 5, a gate claw 1104*a* is rotated in the counterclockwise direction. Thus, a first transferred sheet of paper passes through a pair of rollers 1102*a* and 1103*a* and is then fed onto a bin tray 1101*a*. With respect to second and third transferred sheets of paper, gate claws 1104*b* and 1104*c* are respectively opened sequentially so that the second and third sheets are respectively stacked onto bin trays 1101*b* and 1101*c*. An operating position of a gate claw 1105 with respect to a tenth bin tray 1101*j* is fixed to a position in which this gate claw is opened at any time.

In a front face paper discharging case, an image face constitutes an upper face of the transferred sheet of paper. In this front face paper discharging operation, similar to the case of the two-sided copy, a switch back operation is performed with respect to the transferred sheet of paper in the image forming body and the transferred sheet of paper is fed to the sorter conveying path. An operation for conveying the transferred sheet of paper from the sorter conveying path to the sorter is similar to that in the rear face paper discharging case.

The sorter 1000 switches the front face paper discharging operation and the rear face paper discharging operation. This switching operation of the sorter is performed on the image forming body side as follows in a system for stacking the sheets of paper with each other in the paper resupplying device without the switch back operation as in the synthetic copy. The sheets of paper are conveyed toward the guide plate 1301 in a state in which an image face constitutes a lower face of each of the sheets of paper. Accordingly, the above-mentioned operations are performed in the rear face paper discharging case.

Namely, the gate claw 1302 is located downward and a transferred sheet of paper is directly guided onto an upper ten bin sorter side. In the front face paper discharging operation, the gate claw 1302 is located upward and the transferred sheet of paper is first guided onto a lower ten bin sorter side. At this time, with respect to the transferred sheet of paper, the image face is located on the right-hand side in FIG. 5. When a sensor 1210 detects a rear end of the transferred sheet of paper, rollers 1307, 1205, 1206 and 1207 are rotated in reverse directions. Thus, the transferred sheet of paper is switched back and is fed toward the upper ten bin sorter. Similar to the rear face paper discharging case, the transferred sheet of paper is stacked onto the respective bins in a state in which the image face constitutes an upper face of the transferred sheet of paper on the tray.

Figure 6:
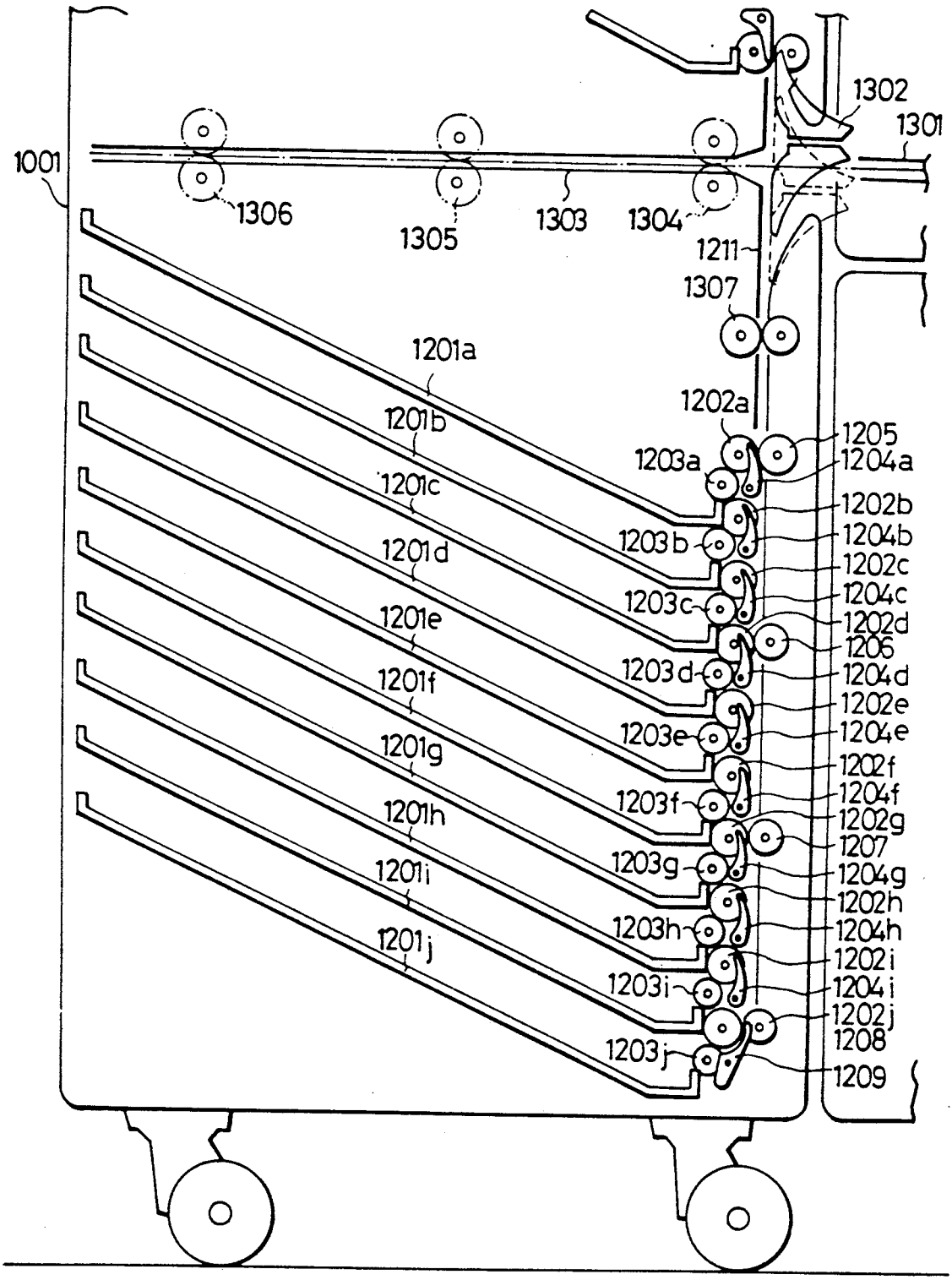
FIG. 6 is an enlarged front view for explaining the construction and operation of a bin sorter arranged in a lower portion of the sorter.

As shown in FIG. 6, in the lower ten bin sorter, a gate claw 1302 is displaced upward so that the transferred sheet of paper is guided downward by the guide plate 1301 and passes through the pair of rollers 1307. A first sheet of paper in the lower ten bin sorter corresponds to an eleventh sheet of paper as a total in the image forming apparatus since an eleventh bin is operated. When this eleventh sheet of paper is fed to the lower ten bin sorter, a gate claw 1204*a* is opened so that the eleventh sheet of paper passes through rollers 1202*a* and 1203*a* and is stacked onto a bin tray 1201*a*. Thereafter, gate claws 1204*b* and 1204*c* are sequentially opened so that the subsequent sheets of paper are respectively stacked onto trays 1201*b* and 1201*c*.

The front face paper discharging operation and the rear face paper discharging operation are switched by the sorter 1000 as follows.

In the rear face paper discharging case, the sheet of paper is directly fed to the lower ten bin sorter by the gate claw 1302 located upward as it is. In the front face paper discharging case, as shown in FIG. 5, the gate claw 1302 is located downward and the sheet of paper passes through the guide plate 1301 and is then fed upward. At this time, with respect to the transferred sheet of paper, the image face is located on the left-hand side in FIG. 5. When a sensor 1110 detects a rear end of the transferred sheet of paper, rollers 1102 and 1103 are rotated in reverse rotations, thereby switching back the transferred sheet of paper. The subsequent operations are similar to the above-mentioned stacking operations. Namely, a gate claw 1204 is opened so that the sheet of paper passes through a pair of rollers 1202 and 1203 and is stacked onto a tray 1201.

Figure 7:
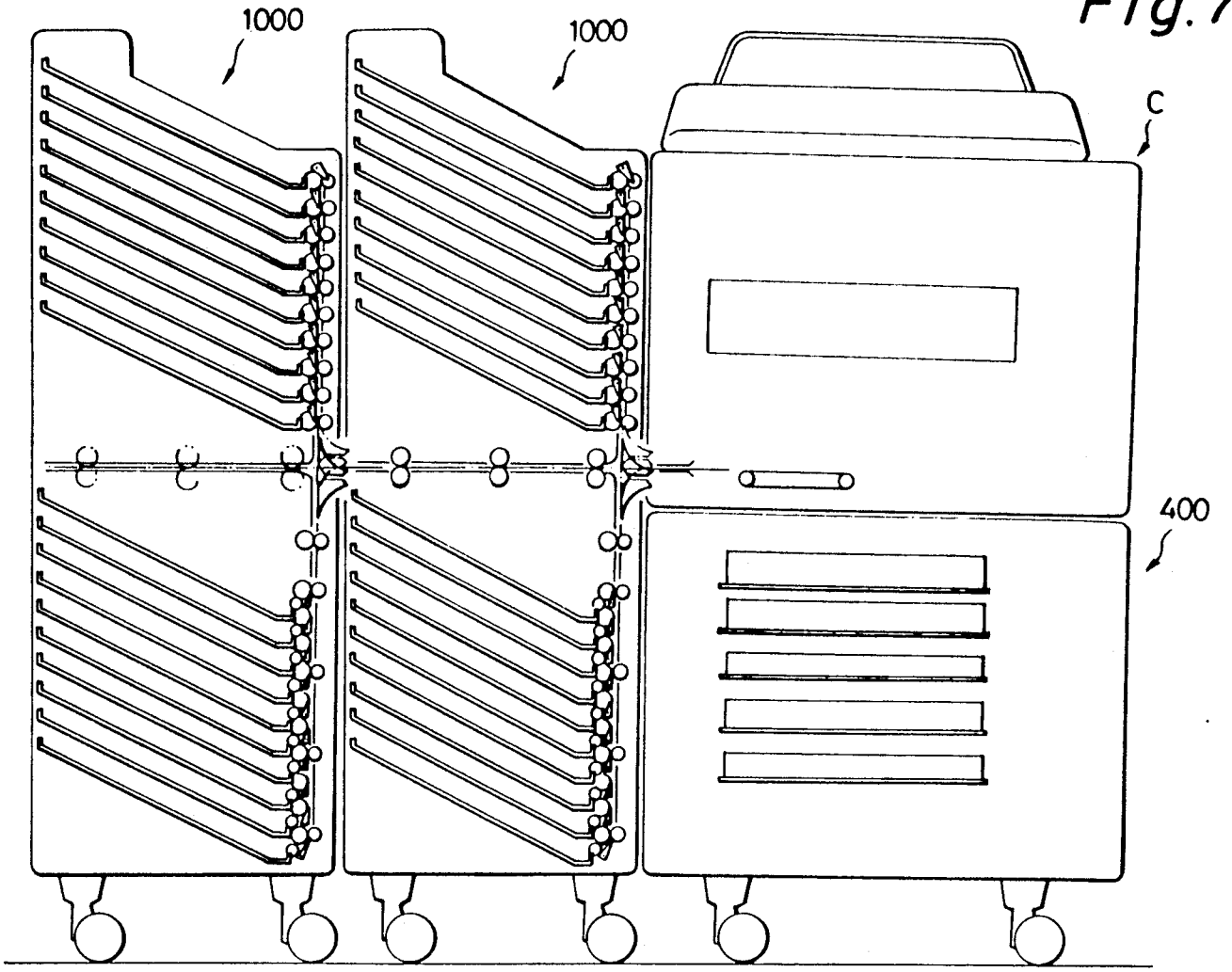
FIG. 7 is a schematic front view for explaining a state in which an additional sorter is further disposed in the image forming apparatus shown in FIG. 1.
Figure 8A:
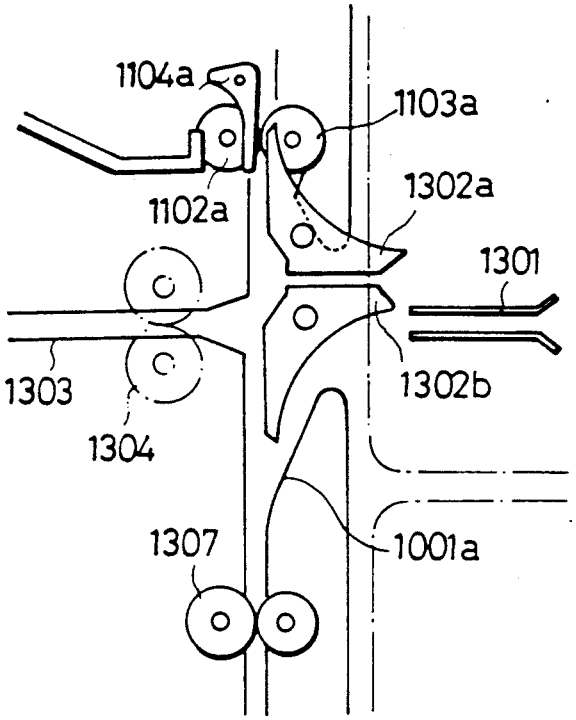
FIGS. 8*a* and 8*b* are enlarged front views for explaining the construction and operation of an inlet portion of the sorter.
Figure 8B:
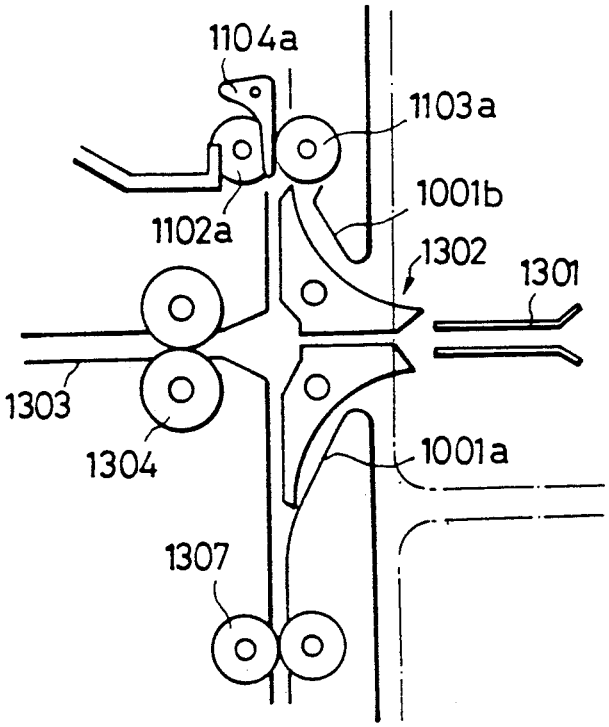

FIG. 7 shows a state in which another twenty bin sorter is further arranged in addition to the above-mentioned twenty bin sorter. The internal construction of this added twenty bin sorter is similar to that of the above-mentioned twenty bin sorter. The transferred sheet of paper is fed to the added twenty bin sorter through a space between the above upper and lower ten bin sorters. At this time, the gate claw 1302 is located in an intermediate position as shown in FIG. 8*b*. The transferred sheet of paper passes through the guide plate 1301 and is horizontally moved as it is and passes through rollers 1304, 1305 and 1306. The operation of the sheet of paper after a guide plate 1303 is similar to that in the case of the above-mentioned twenty bin sorter after the guide plate 1301.

The conveying operations of the above forward conveying rollers 923, 924 and 925 and the perpendicular conveying roller 926 are selectively performed and stopped by a common change-over mechanism as described later with reference to FIG. 9.

In this embodiment, 40 cpm (copies per minute) is obtained in the case of paper size A4. 27 cpm is obtained in the case of paper size B4 when the sheet of paper of this size is fed in a longitudinal direction thereof. 23 cpm is obtained in the case of paper size A3 when the sheet of paper of this size is fed in a longitudinal direction thereof. After a rear end of the sheet of paper having a largest size has passed through the fixing roller 701, a front end of the sheet of paper is supported by the forward conveying roller 923.

As mentioned above, with respect to the forward conveying rollers respectively disposed in the forward and perpendicular conveying paths, the pinch rollers 923*a*, 924*a* and 925*a* respectively come in press contact with the drive rollers 923, 924 and 925 rotated at any time, or are separated therefrom at predetermined timings. Thus, the sheet of paper is discharged in a direction perpendicular to the paper conveying direction of the sorter.

Namely, the pinch rollers 923*a*, 924*a* and 925*a* as press contact rollers respectively come in press contact with the drive rollers 923, 924 and 925 constituting the forward conveying rollers in the forward conveying path. Thus, a sheet of recording paper is conveyed from the forward conveying path to the perpendicular conveying path. When the sheet of recording paper is moved to a predetermined position, the pinch rollers 923*a*, 924*a* and 925*a* are respectively separated from the drive rollers 923, 924 and 925. Therefore, no conveying force in the forward direction is applied to the sheet of recording paper.

Simultaneously, the pinch roller 926*a* constituting a press contact roller comes in press contact with the above drive roller 926 constituting the perpendicular conveying roller. Thus, conveying force in the perpendicular direction is applied to the sheet of recording paper. Therefore, the conveying direction of the sheet of recording paper is rapidly changed in a constant position at any time and the sheet of recording paper is fed to the sorter.

Figure 9:
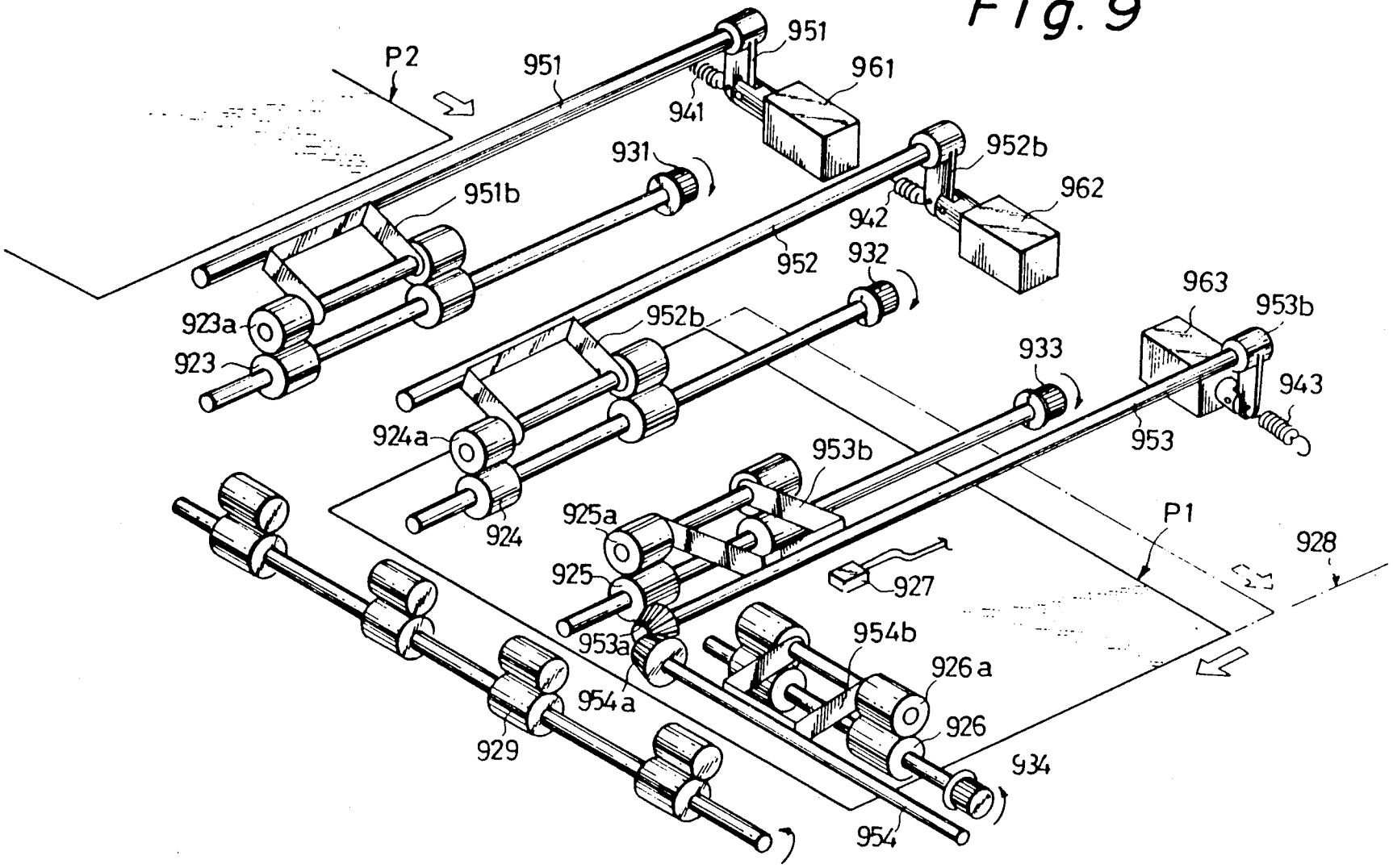
FIG. 9 is a perspective view for explaining a main section of the paper conveying mechanism in the embodiment of the present invention.

FIG. 9 shows the construction of the paper conveying mechanism for performing the above-mentioned operations.

In FIG. 9, the pinch rollers 923*a*, 924*a* and 925*a* with respect to the forward conveying rollers 923, 924 and 925 are respectively biased in a pressurizing direction by resilient members 941, 942 and 943 composed of springs, etc. through support shafts 951, 952 and 953. The pinch roller 926*a* with respect to the perpendicular conveying roller 926 is biased in a pressurizing direction by a resilient member 944 composed of a spring, etc. through a support shaft 954.

The support shaft 953 of the pinch roller 925*a* and the support shaft 954 of the pinch roller 926*a* are extended in directions perpendicular to each other. A bevel gear 953*a* is fixed to an end portion of the support shaft 953 of the pinch roller 925*a*. This bevel gear 953*a* is engaged with a bevel gear 954*a* fixed to an end portion of the support shaft 954 of the pinch roller 926*a*. Thus, a rotary movement of the support shaft 953 is transmitted onto the side of the support shaft 954 so that both the shafts are simultaneously rotated.

The forward conveying rollers 923, 924 and 925 receive rotary driving force from input pulleys 931, 932 and 933, respectively. The perpendicular conveying roller 926 receives rotary driving force from an input pulley 934.

The transferred sheet of paper is conveyed at a predetermined speed by conveying actions of the forward conveying rollers 923, 924 and 925. A front end of the sheet of paper is detected by a paper detecting sensor 927 after the sheet of paper has passed through the forward conveying roller 925 on a most downstream side of the conveying path. The sheet of paper is stopped by a detecting signal of the paper detecting sensor 927 such that the front end of the sheet of paper is aligned with a stopping position 928. Simultaneously, the conveying direction of the sheet of paper is changed by 90° as follows.

The conveying direction of the sheet of paper is changed by sucking operations of plunger solenoids 961, 962 and 963 respectively connected to the support shafts 951, 952 and 953 of the pinch rollers 923*a*, 924*a* and 925*a*. Namely, the respective support shafts 951, 952 and 953 are rotated by constant angles by the sucking operations of the plunger solenoids 961, 962 and 963. Thus, the pinch rollers 923*a*, 924*a* and 925*a* of the forward conveying rollers 923, 924 and 925 are escaped to their releasing positions and the transferred sheet of paper is stopped. Simultaneously, the rotary movement of the support shaft 953 is transmitted onto the side of the support shaft 954. Thus, the pinch roller 926*a* of the perpendicular conveying roller 926 is pressed and biased so that the conveying force in the perpendicular direction is applied to the transferred sheet of paper.

Such a mechanism for switching the conveying directions of the sheet of paper can be constructed by other means such as a cam, etc. Thus, the transferred sheet of paper is conveyed in a direction perpendicular to the previous conveying direction. Accordingly, the conveying direction of the sheet of recording paper is rapidly changed in a constant position at any time and the sheet of paper is conveyed in the above perpendicular direction and is fed to the sorter.

The sucking operations of the plunger solenoids 961, 962 and 963 are released immediately after a preceding transferred sheet of paper P1 has been escaped from the paper conveying mechanism. The pinch rollers 923*a*, 924*a* and 925*a* respectively receive tension from the resilient members 941, 942 and 943 so that these pinch rollers are pressed and biased. Thus, the conveying force is again applied to the forward conveying rollers 923, 924 and 925 to convey a subsequent transferred sheet of paper P2.

In this embodiment, the respective conveying rollers in the forward conveying path selectively have either a paper conveying speed $V_1$ equal to an image forming process speed or a paper conveying speed $V_2$ set to be higher than the image forming process speed by providing a predetermined relation therebetween. The conveying speeds of the forward conveying rollers in the forward conveying path are set on the basis of a width h of the transferred sheet of paper with respect to the conveying direction thereof and a distance i between the transferred sheets of paper. Concretely, as described later, paper conveying speeds in the forward direction are set by using, as a reference, the transferred sheet of paper having a largest value with respect to a difference m ($=h-i$) between the paper width h and the distance i. At this time, a switching operation of the paper conveying speeds is performed by using, as a reference, a detecting signal indicative of a rear end of the transferred sheet of paper immediately after the sheet of paper has been discharged from the fixing device 700.

The above switching operation is concretely performed as follows with respect to transversal feed of paper size A4, longitudinal feed of paper size B4 and longitudinal feed of paper size A3. The respective conveying rollers in the perpendicular conveying path have the paper conveying speed $V_2$ set to be higher than the image forming process speed by providing a predetermined relation therebetween.

The difference m (=h−i) between the paper width h with respect to the conveying direction and the distance i between the transferred sheets of paper is calculated as follows in the cases of paper sizes A4, B4 and A3.

A4; m=h−i=297−165=132 (mm).

B4; m=h−i=257−190=67 (mm).

A3; m=h−i=297−233=64 (mm).

The size of the transferred sheet of paper having a largest value with respect to the difference m is A4. Accordingly, the above paper conveying speeds are set with the paper size A4 as a reference.

Figure 10A:
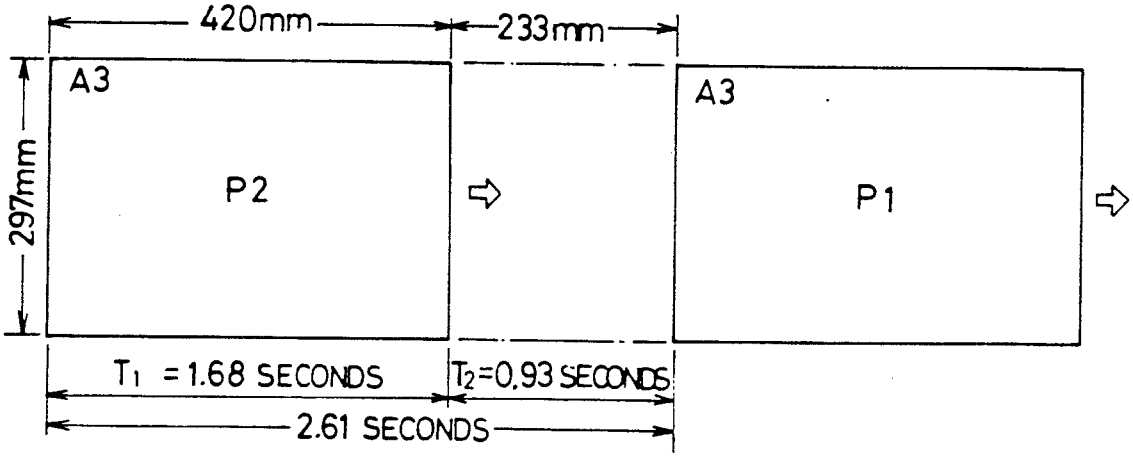
FIGS. 10 and 11 are plan views for respectively explaining paper conveying states in the paper conveying mechanism shown in FIG. 9.
Figure 10B:
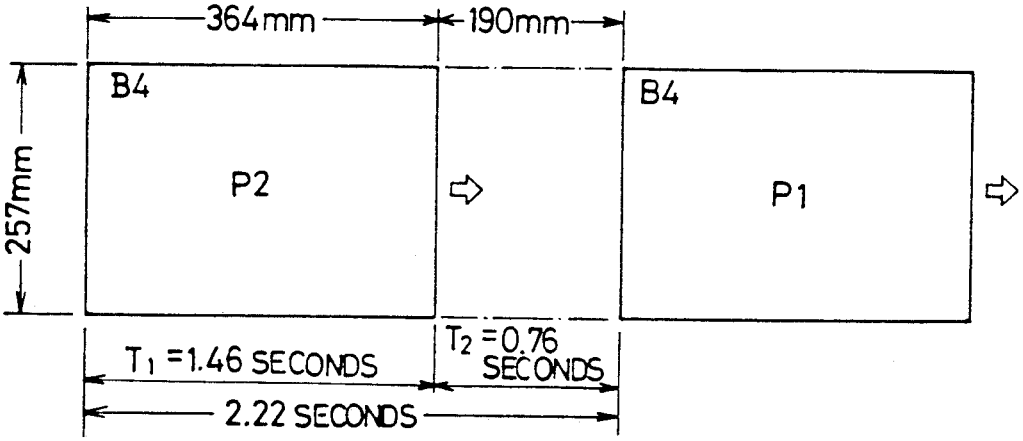
Figure 10C:
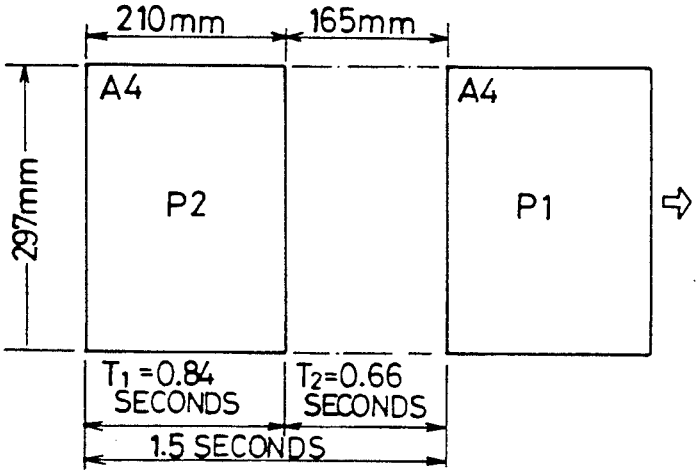
Figure 11A:
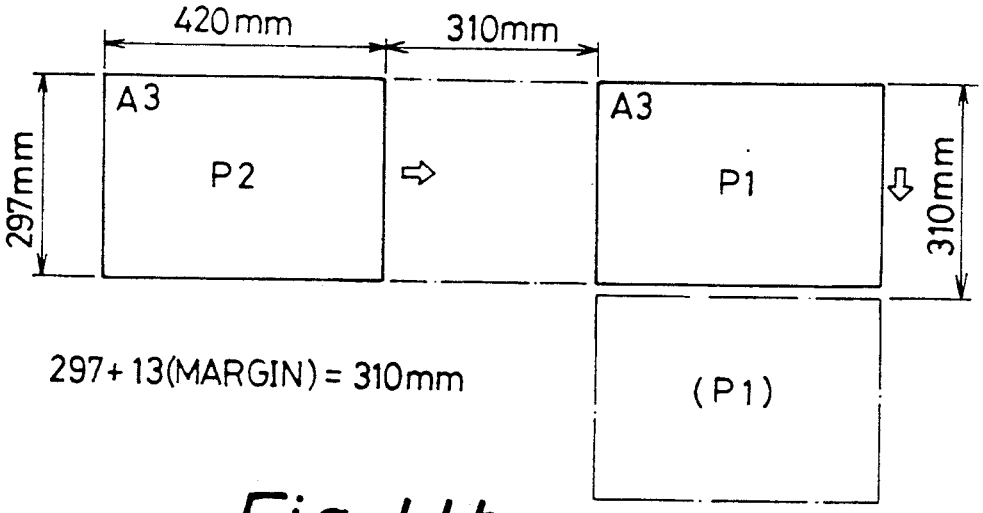
Figure 11B:
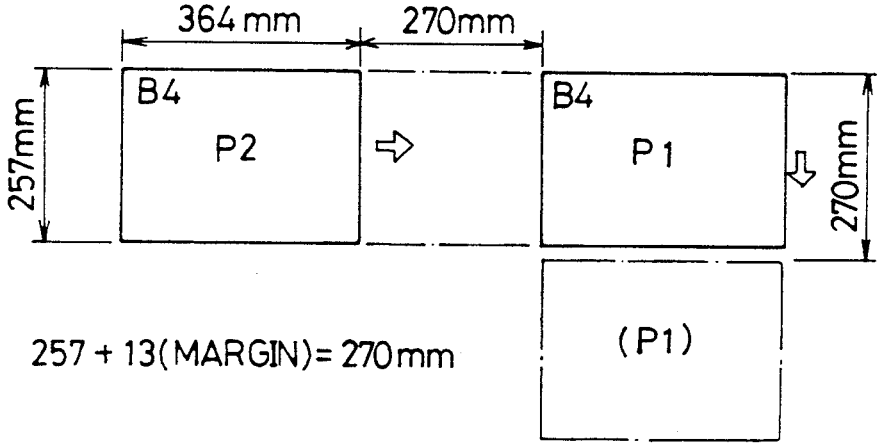
Figure 11C:
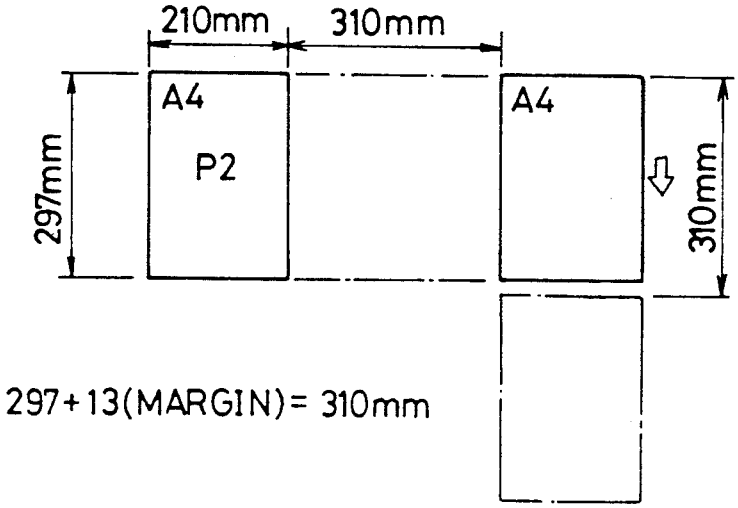
Figure 12A:
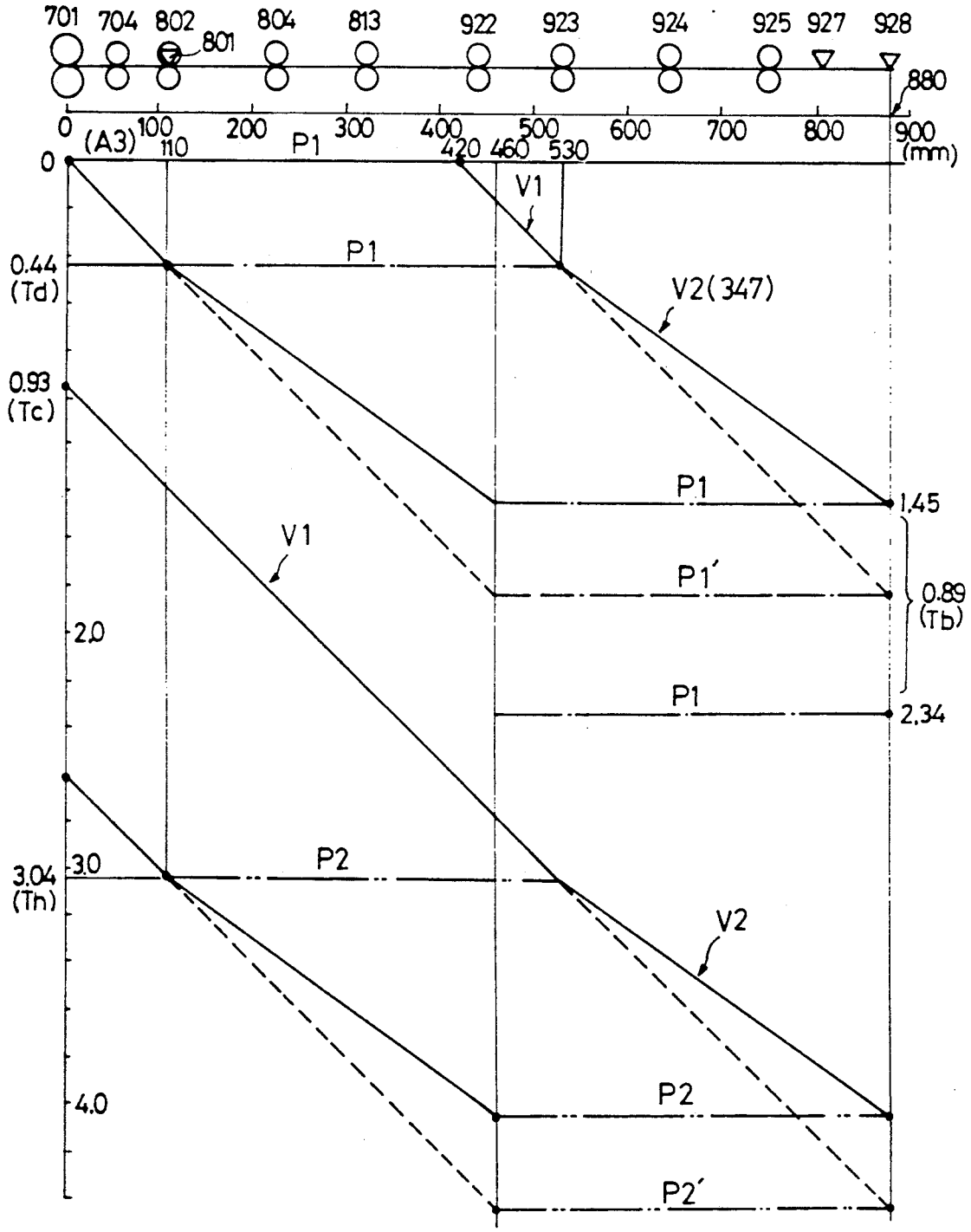
FIGS. 12 and 13 are diagrams for respectively explaining actions of the paper conveying mechanism shown in FIG. 9.
Figure 12B:
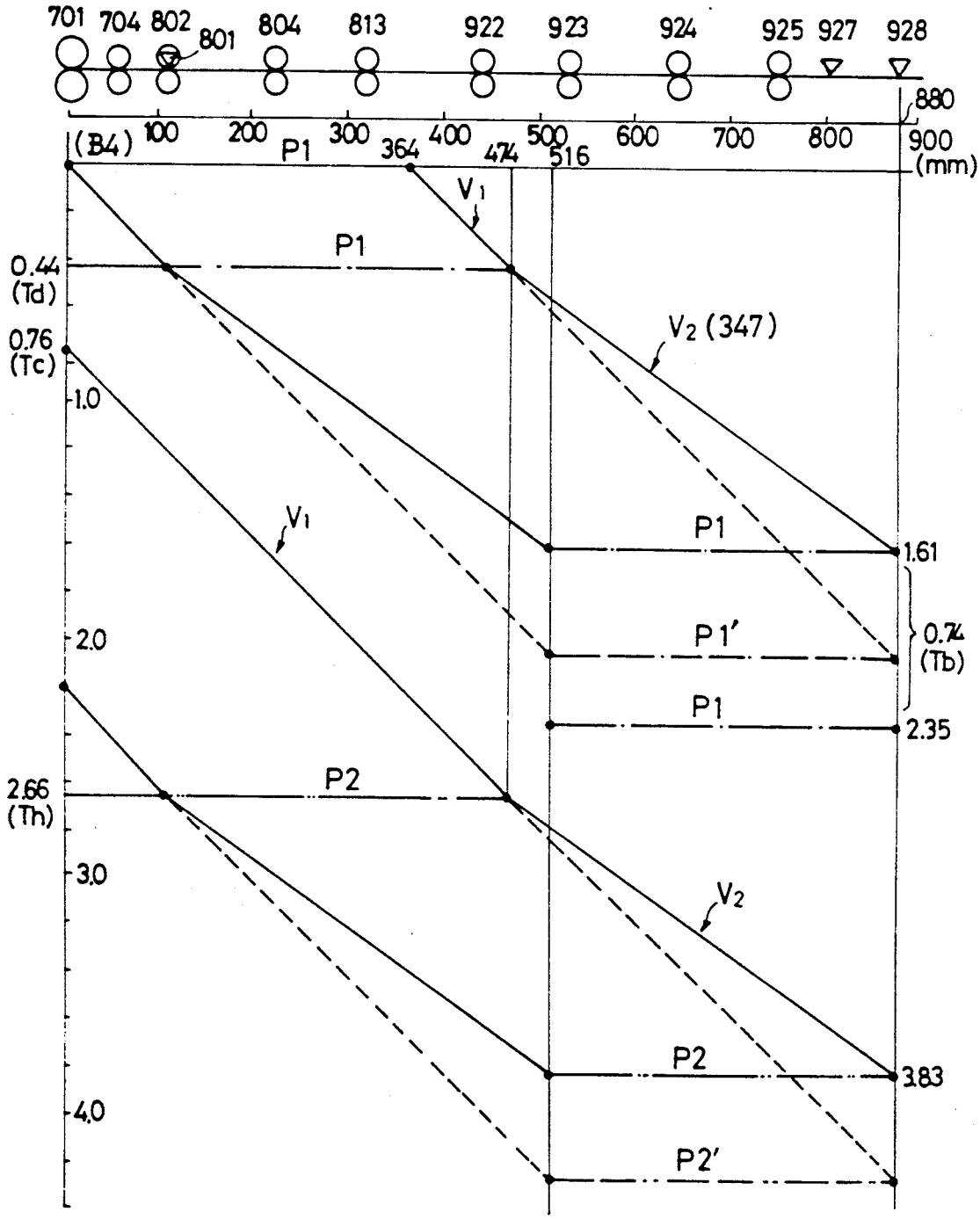
Figure 12C:
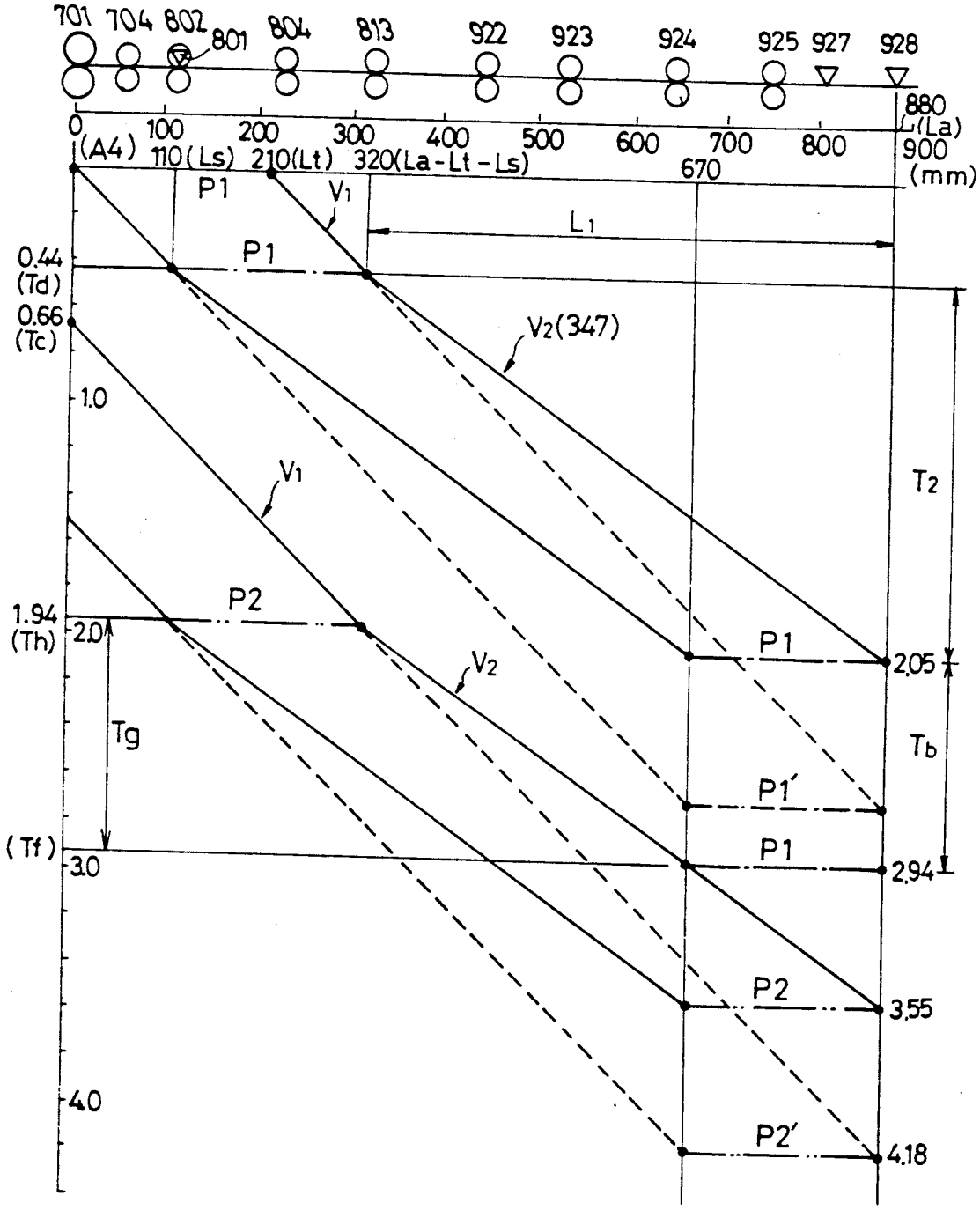

As shown in FIGS. 10*c*, 11*c* and 12*c*, in the case of the transversal feed of the paper size A4, a toner image on the photosensitive drum 601 is transferred onto a transferred sheet of paper and this transferred sheet of paper is fed to the fixing device 700. The toner image is fixed onto the transferred sheet of paper in this fixing device 700. Thereafter, the transferred sheet of paper passes through the pair of fixing-discharging rollers 704 and has reached the paper detecting sensor 801. At this time, the conveying speed of the transferred sheet of paper is set to the low conveying speed $V_1$ about 250 mm/sec equal to the process speed. As shown in FIG. 10*c*, the paper width h with respect to the conveying direction of the transferred sheet of paper is set to 297 mm and the distance i between the transferred sheets of paper is set to about 165 mm. The transferred sheet of paper is then fed through the pair of conveying rollers 802 and the conveying roller 804 toward the turn conveying path 823. At this time, the gate claw 805 is displaced to the upper position shown by the broken line in FIG. 1.

When the paper detecting sensor 801 detects a rear end of the transferred sheet of paper, the conveying speeds of a group of forward conveying rollers composed of the conveying roller 804 and the subsequent rollers are switched to the high conveying speed $V_2$. At this time, the high conveying speed $V_2$ is determined as follows.

In the following description, reference numeral L1 designates a distance from a front end of the sheet of paper to the paper stopping position 928 when the rear end of the sheet of paper is detected by the paper detecting sensor 801. Reference numeral La designates a distance from the fixing roller 701 to the stopping position 928 and is set to 880 mm in this embodiment. Reference numeral Lt designates a length of the transferred sheet of paper in the conveying direction thereof and is set to 210 mm in the case of the paper size A4. Reference numeral Ls designates a distance from the fixing roller 701 to the paper detecting sensor 801 and is set to 110 mm in this embodiment. In this case, the distance L1 is provided as follows.

$$L1 = La - Lt - Ls$$

Further, in the following description, reference numeral T2 designates a time until the front end of the transferred sheet of paper reaches the stopping position 928 after the rear end of the preceding transferred sheet of paper P1 has been detected by the paper detecting sensor 801. Reference numeral Tf designates a time required to make the subsequent transferred sheet of paper P2 reach the preceding transferred sheet of paper P1. Reference numeral Tb designates a time required to move the preceding transferred sheet of paper P1 by the width thereof in the widthwise direction. Reference numeral Td designates a time at which the rear end of the preceding transferred sheet of paper P1 is detected by the paper detecting sensor 801. In this case, the time T2 is provided as follows.

$$T2 = Tf - Tb - Td.$$

Further, in the following description, reference numeral Tg designates a time required to make the subsequent transferred sheet of paper P2 reach the preceding transferred sheet of paper P1 by a high speed conveying operation. Reference numeral Th designates a time at which the rear end of the subsequent transferred sheet of paper P2 is detected by the paper detecting sensor 801. In this case, the times Tg and Th are provided as follows.

$$\begin{aligned} Tg &= (La - 2 \times Lt - Ls)/V_2 \\ Th &= Tc + (Lt + Ls)/V_1 \\ &= i/V_1 + (Lt + Ls)/V_1 \\ &= (i + Lt + Ls)/V_1 \end{aligned}$$

The above time Tf is provided as follows.

$$Tf = Tg + Th.$$

Accordingly, in consideration of the following formulas, $$Tb = (h+m)/V_1$$

$$Td = Ls/V_1$$

the time Tf is provided as follows.

$$Tf = (La - 2 \times Lt - Ls)/V_2 + (i + Lt + Ls)/V_1$$

Accordingly, the time T2 (=Tf−Tb−Td) is represented as follows.

$$\begin{aligned} T2 &= (La - 2 \times Lt - Ls)/V_2 + \\ &\quad (i + Lt + Ls)/V_1 - (h + m)/V_2 - Ls/V_1 \\ &= (La - 2 \times Lt - Ls - h - m)/V_2 + \\ &\quad (i + Lt)/V_1 \end{aligned}$$

Namely, the conveying speed $V_2$ is represented as follows.

$$V_2 = V_1 \times (Lt + h + m)/(i + Lt).$$

At time time, as shown in FIG. 10*c*, the distance i between the transferred sheets of paper is set to about 165 mm and the paper width h is set to 297 mm. When such real values are substituted for the distance i and the width h in the above formula of the conveying speed $V_2$, the conveying speed $V_2$ is determined as follows.

$$V_2 = 250 \times (210 + 297 + 13)/(165 + 210)$$
$$= 250 \times 520/375$$
$$= 347(\text{mm/sec})$$

In the case of the transversal feed of the paper size A4, when the rear end of the transferred sheet of paper is detected by the paper detecting sensor 801, the conveying speeds of the respective conveying rollers 804, 813, 922, 923, 924, 925 and 926 are switched from the low conveying speed $V_1$ to the high conveying speed $V_2$. The conveying speeds of the conveying rollers 923, 924, 925 and 926 are set to only the high conveying speed $V_2$.

When the transferred sheet of paper is conveyed at the high conveying speed $V_2$ (347 mm/sec) obtained as above, the preceding transferred sheet of paper P1 is discharged from the fixing roller 701 and has reached the stopping position 928 after about 2.05 seconds as shown in FIG. 12*c*.

Subsequently, the sheet of paper is conveyed in the perpendicular direction and is completely escaped in a position in which the preceding transferred sheet of paper P1 is separated by about 13 mm from the susequent transferred sheet of paper P2 for about 2.94 seconds.

At this time, the conveying speeds of the conveying rollers 804, 813 and 922 are returned to the original low conveying speed $V_1$ after the rear end of the conveyed sheet of paper has passed through the roller 922.

As mentioned above, the transferred sheet of paper having the high conveying speed $V_2$ reaches the stopping position 928 after about 1.61 seconds. Then, the transferred sheet of paper is conveyed in the perpendicular direction and is completely escaped in a position in which the preceding transferred sheet of paper P1 is separated by about 13 mm from the subsequent transferred sheet of paper P2 for about 2.35 seconds. The switching and conveying operations of the transferred sheet of paper with respect to the perpendicular direction are similar to those in the case of the paper size A4.

In the case of the longitudinal feed of the paper size B4, as shown in FIGS. 10*b*, 11*b* and 12*b*, a conveying operation of this paper size is basically similar to that in the case of the transversal feed of the paper size A4.

Namely, a transferred sheet of paper having this size B4 is conveyed at a conveying speed about 250 mm/sec equal to the image forming process speed $V_1$. When a rear end of the transferred sheet of paper is detected by the paper detecting sensor 801, the conveying speeds of the group of forward conveying rollers composed of the conveying roller 804 and the subsequent rollers are switched to the high conveying speed $V_2$. At this time, the high conveying speed $V_2$ is set to a speed 347 mm/sec equal to the high conveying speed $V_2$ in the case of the paper size A4. As shown in FIG. 12*b*, a preceding transferred sheet of paper P1 is discharged from the fixing roller 701 and has reached the stopping position 928 after about 1.61 seconds. Subsequently, the sheet of paper is conveyed in the perpendicular direction and is completely escaped in a position in which the preceding transferred sheet of paper P1 is separated by about 13 mm from a subsequent transferred sheet of paper P2 after about 2.35 seconds. The switching and conveying operations of the transferred sheet of paper with respect to the perpendicular direction are similar to those in the case of the paper size A4.

In the case of the longitudinal feed of the paper size A3, as shown in FIGS. 10*a*, 11*a* and 12*a*, a conveying operation of this paper size is basically similar to the conveying operations in the cases of the transversal feed of the paper size A4 and the longitudinal feed of the paper size B4.

Namely, a transferred sheet of paper having this size A3 is conveyed at a conveying speed about 250 mm/sec equal to the image forming process speed $V_1$. When a rear end of the transferred sheet of paper is detected by the paper detecting sensor 801, the conveying speeds of the group of forward conveying rollers composed of the conveying roller 804 and the subsequent rollers are switched to the high conveying speed $V_2$. At this time, the high conveying speed $V_2$ is set to a speed 347 mm/sec equal to the high conveying speed $V_2$ in the cases of the paper sizes A4 and B4. As shown in FIG. 12*a*, a preceding transferred sheet of paper P1 is discharged from the fixing roller 701 and has reached the stopping position 928 after about 1.45 seconds. Subsequently, the sheet of paper is conveyed in the perpendicular direction and is completely escaped in a position in which the preceding transferred sheet of paper P1 is separated by about 13 mm from a subsequent transferred sheet of paper P2 after about 2.34 seconds. The switching and conveying operations of the transferred sheet of paper with respect to the perpendicular direction are similar to those in the cases of the paper sizes A4 and B4.

As mentioned above, in the operation for discharging the sheet of paper to the sorter in the perpendicular direction, the paper feed speed in the forward conveying path is increased at a predetermined timing while the relation between the paper feed speed and the process speed is constantly held. Thus, the distance between the preceding sheet of paper P1 and the subsequent sheet of paper P2 in the forward conveying path is set to a value greater than a predetermined value. The preceding sheet of paper P1 is fed to an inlet portion of the perpendicular conveying path. After the preceding sheet of paper has been discharged from this inlet portion, the subsequent sheet of paper P2 is fed to the inlet portion of the perpendicular conveying path. Therefore, it is possible to reliably prevent the preceding and subsequent sheets of paper from overlapping in the inlet portion of the perpendicular conveying path.

Namely, as mentioned above, the high conveying speed $V_2$ is determined by the width h of the transferred sheet of paper and the distance i between the transferred sheets of paper in any size of the transferred sheet of paper. It is possible to prevent the transferred sheets of paper from overlapping by providing the same distance therebetween in any size of the transferred sheet of paper. Thus, the transferred sheets of paper are preferably discharged.

In the above embodiment, the conveying speeds of the respective conveying rollers in the forward conveying path are set to a conveying speed equal to the image forming process speed. The conveying speeds of the respective conveying rollers in the perpendicular conveying path are set to a conveying speed higher than the above process speed by providing a constant relation therebetween.

In the following description, the conveying speeds of the respective conveying rollers are set in the cases of the longitudinal feeds of the paper sizes A3 and B4 and the transversal feed of the paper size A4.

Figure 13A:
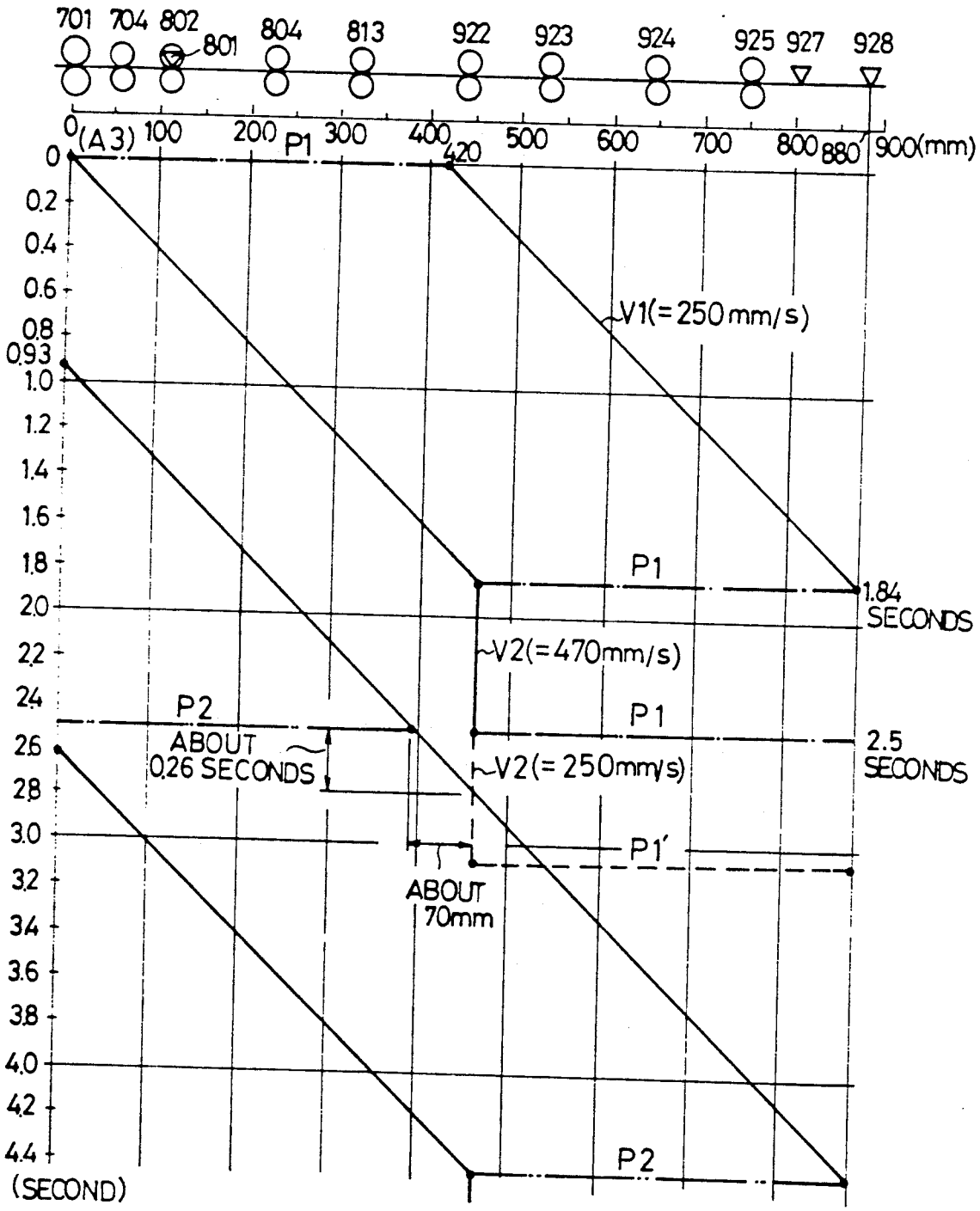

In the case of the longitudinal feed of the paper size A3 shown in FIGS. 10*a* and 11*a* used to explain the above forward conveying speed and FIG. 13*a* newly added, a toner image on the photosensitive drum 601 is transferred onto a transferred sheet of paper. The transferred sheet of paper then passes through the fixing device 700 so that the toner image is fixed onto the transferred sheet of paper. Thereafter, the transferred sheet of paper sequentially passes through the pair of fixing-discharging rollers 704, the conveying rollers 802, 804, 813, 922, etc. The gate claw 805 is displaced to the position shown by the broken line FIG. 1 so that the transferred sheet of paper is guided to the turn conveying path 823. The gate claw 814 is located in the position shown by the solid line in FIG. 1 so that the transferred sheet of paper is guided to the turn conveying path 826.

At this time, the conveying speed of the transferred sheet of paper is set to the low conveying speed $V_1$ equal to the image forming process speed about 250 mm/sec. As shown in FIG. 10*a*, the distance between the transferred sheets of paper is set to about 233 mm. The transferred sheet of paper is then fed to the forward conveying roller 923. The conveying speeds of the respective forward conveying rollers 923, 924 and 925 are also set to the low conveying speed $V_1$ equal to the image forming process speed about 250 mm/sec.

After the transferred sheet of paper P1 has passed through the forward conveying roller 925, a front end of the transferred sheet of paper is detected by the paper detecting sensor 927. The front end of the transferred sheet of paper is then aligned with the stopping position 928 by a detecting signal of the paper detecting sensor 927 and the transferred sheet of paper is once stopped. As shown in FIG. 13*a*, the transferred sheet of paper is stopped after about 1.84 seconds since a rear end of the transferred sheet of paper P1 has been discharged from the fixing roller 701. Then, the conveying direction of the transferred sheet of paper P1 is changed by 90°.

The conveying speed of the perpendicular conveying roller 926 is set to a speed about 470 mm/sec higher than the above image forming process speed about 250 mm/sec. When a time about 0.66 seconds has passed since the conveying operation of the sheet of paper is started in the perpendicular direction, the preceding transferred sheet of paper P1 is conveyed by a distance about 310 mm in the perpendicular direction as shown in FIG. 11*a*. Thus, the preceding transferred sheet of paper P1 is separated from the subsequent transferred sheet of paper P2 by a distance about 13 mm as a margin after about 2.5 seconds since the rear end of the preceding transferred sheet of paper P1 has been discharged from the fixing roller 701. At this time, a front end of the subsequent transferred sheet of paper P2 is located between the conveying rollers 813 and 922 and the distance between the transferred sheets of paper is set to about 70 mm.

Thus, the preceding transferred sheet of paper P1 is completely discharged. When the perpendicular conveying speed is set to the image forming process speed as it is, this conveying speed is provided as shown by a broken line in FIG. 13*a* so that the preceding transferred sheet of paper P1 overlaps the subsequent transferred sheet of paper P2.

Figure 13B:
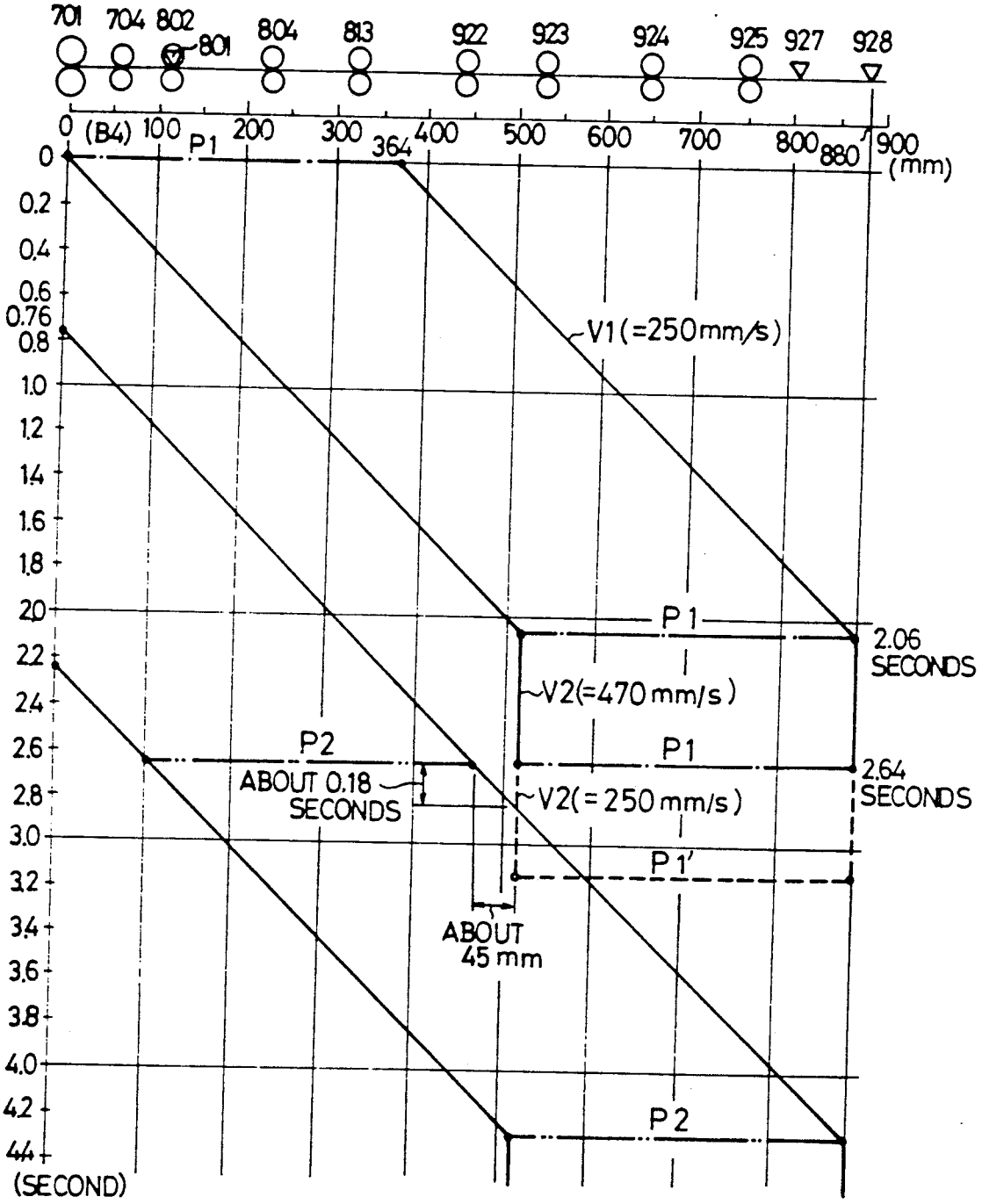

In the case of the longitudinal feed of the paper size B4 shown in FIGS. 10*b*, 11*b* and 13*b*, a paper conveying operation is basically similar to that in the case of the above longitudinal feed of the paper size A3. Namely, the conveying speeds of the respective forward conveying rollers 923, 924 and 925 are set to the low conveying speed $V_1$ equal to the image forming process speed about 250 mm/sec. After the transferred sheet of paper P1 has passed through the forward conveying roller 925, a front end of the transferred sheet of paper P1 is detected by the paper detecting sensor 927. The front end of the transferred sheet of paper P1 is then aligned with the stopping position 928 by a detecting signal of the paper detecting sensor 927 and the transferred sheet of paper is once stopped. As shown in FIG. 13*b*, the transferred sheet of paper P1 is stopped after about 2.06 seconds since a rear end of the transferred sheet of paper P1 has been discharged from the fixing roller 701. Then, the conveying direction of the transferred sheet of paper P1 is changed by 90°.

The conveying speed of the perpendicular conveying roller 926 is set to a speed about 470 mm/sec higher than the above image forming process speed about 250 mm/sec. When a time about 0.57 seconds has passed since the conveying operation of the sheet of paper is started in the perpendicular direction, the preceding transferred sheet of paper P1 is conveyed by a distance about 270 mm in the perpendicular direction as shown in FIG. 11*b*. Thus, the preceding transferred sheet of paper P1 is separated from the subsequent transferred sheet of paper P2 by a distance about 13 mm as a margin after about 2.64 seconds as shown in FIG. 13*b* since the rear end of the preceding transferred sheet of paper P1 has been discharged from the fixing roller 701. At this time, a front end of the subsequent transferred sheet of paper P2 is located between the conveying roller 922 and the forward conveying roller 923 and the distance between the transferred sheets of paper is set to about 45 mm.

Thus, the preceding transferred sheet of paper P1 is completely discharged. When the perpendicular conveying speed is set to the image forming process speed as it is, this conveying speed is provided as shown by a broken line in FIG. 13*b* so that the preceding transferred sheet of paper P1 overlaps the subsequent transferred sheet of paper P2.

Figure 13C:
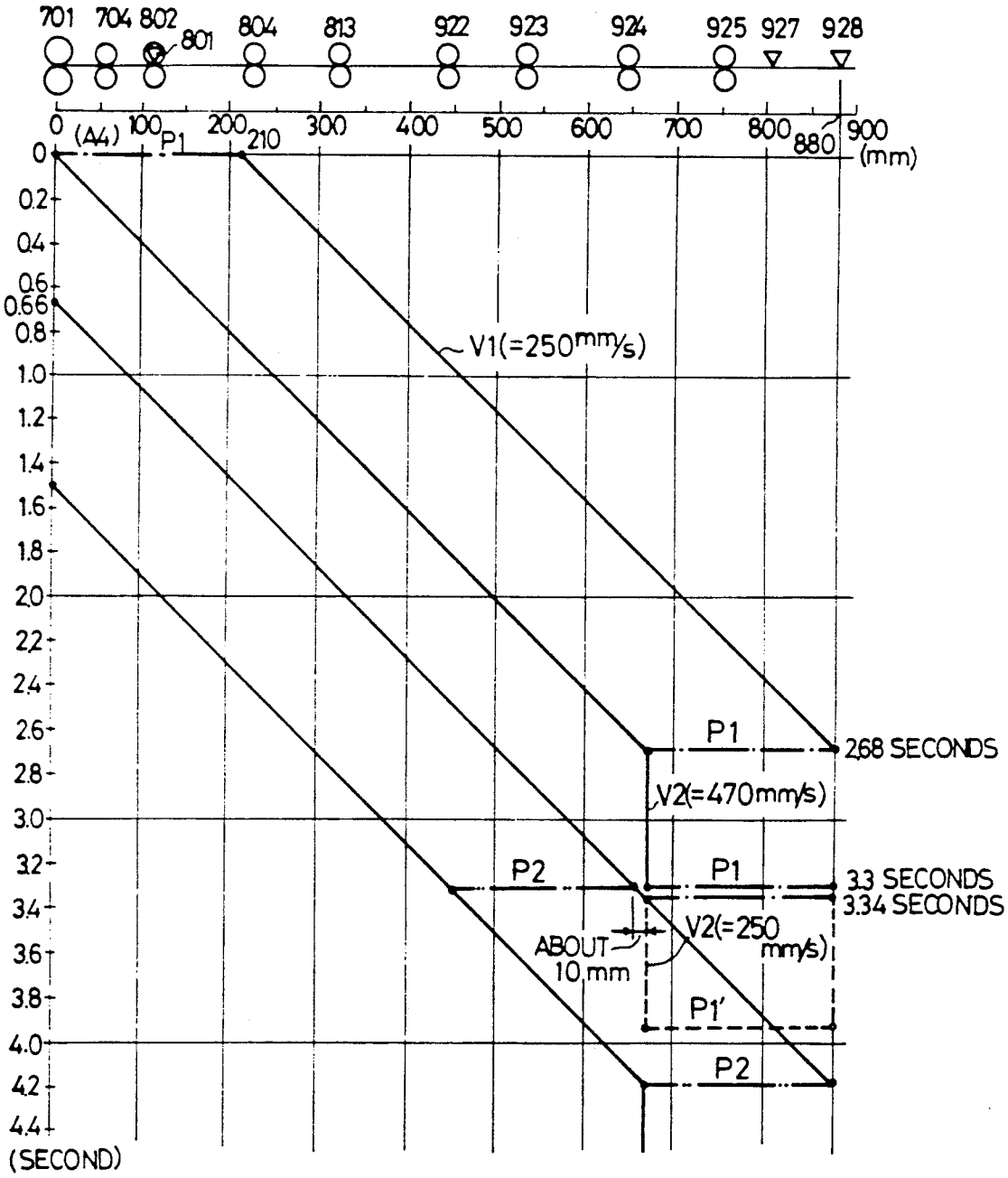

In the case of the transversal feed of the paper size A4 shown in FIGS. 10*c*, 11*c* and 13*c*, a paper conveying operation is basically similar to that in the cases of the above longitudinal feeds of the paper sizes A3 and B4. Namely, the conveying speeds of the respective forward conveying rollers 923, 924 and 925 are set to the low conveying speed $V_1$ equal to the image forming process speed about 250 mm/sec. After the transferred sheet of paper P1 has passed through the forward conveying roller 925, a front end of the transferred sheet of paper is detected by the paper detecting sensor 927. The front end of the transferred sheet of paper is then aligned with the stopping position 928 by a detecting signal of the paper detecting sensor 927 and the transferred sheet of paper is once stopped. As shown in FIG. 13*c*, the transferred sheet of paper P1 is stopped after about 2.68 seconds since a rear end of the transferred sheet of paper P1 has been discharged from the fixing roller 701. Then, the conveying direction of the transferred sheet of paper P1 is changed by 90°.

The conveying speed of the perpendicular conveying roller 926 is set to a speed about 470 mm/sec higher than the above image forming process speed about 250 mm/sec. When a time about 0.66 seconds has passed since the conveying operation of the sheet of paper is started in the perpendicular direction, the preceding transferred sheet of paper P1 is conveyed by a distance about 310 mm in the perpendicular direction as shown in FIG. 11c. Thus, the preceding transferred sheet of paper P1 is separated from the subsequent transferred sheet of paper P2 by a distance about 13 mm as a margin after about 3.34 seconds since the rear end of the preceding transferred sheet of paper P1 has been discharged from the fixing roller 701. At this time, a front end of the subsequent transferred sheet of paper P2 is located between the conveying roller 922 and the forward conveying roller 923.

The preceding transferred sheet of paper P1 is substantially separated from the perpendicular conveying path when a time about 3.3 seconds has passed since the rear end of the transferred sheet of paper P1 is discharged from the fixing roller 701. At this time, the subsequent transferred sheet of paper P2 is located in a backward position separated from the preceding transferred sheet of paper P1 by a distance about 10 mm. Accordingly, the subsequent transferred sheet of paper does not overlap the preceding transferred sheet of paper. The conveying speed (about 470 mm/sec) of the perpendicular conveying roller 926 is determined on the basis of the transversal feed of the paper size A4 having the smallest distance between the transferred sheets of paper.

Thus, the preceding transferred sheet of paper P1 is completely discharged. When the perpendicular conveying speed is set to the image forming process speed as it is, this conveying speed is provided as shown by a broken line in FIG. 13c so that the preceding transferred sheet of paper P1 overlaps the subsequent transferred sheet of paper P2.

In this embodiment, the following effects can be obtained by using the sorter constructed above.

(1) The transferred sheet of paper is taken out of the paper conveying mechanism in the front direction thereof. An end portion of the transferred sheet of paper can be arranged on the front side of the paper conveying mechanism irrespective of the paper size. Accordingly, the transferred sheet of paper can be easily taken out of the paper conveying mechanism.

(2) It is possible to easily perform after-treatments such as stapling and punching operations manually with respect to the end portion of the transferred sheet of paper.

(3) When the transferred sheet of paper is jammed in a sorting operation, it is easy to take the jammed sheet of paper out of the paper conveying mechanism since the end portion of the transferred sheet of paper is located on the front side of the paper conveying mechanism.

(4) It is possible to feed the transferred sheet of paper having a relatively large size such as A3, B4, etc. in the transversal direction thereof. Accordingly, conveying efficiency is improved and it is possible to rapidly perform the sorting operation with respect to the transferred sheet of paper.

(5) The transferred sheet of paper having the largest size A3 is fed in the transversal direction thereof and is stacked onto a bin tray. Accordingly, the width of the sorter can be reduced so that a space for arranging the paper conveying mechanism can be reduced. It is possible to further reduce the width of the sorter by limiting the number of sheets of paper stacked onto the bin tray and inclining the bin tray by a predetermined angle.

(6) The bin sorter can be additionally disposed so that it is possible to sufficiently provide a large-sized sorter in compliance with a user's wishes. In this case, it is also possible to prevent conveying ability from being reduced by reducing a conveying path of the sorter.

As mentioned above, in accordance with the present invention, a discharging path for feeding a sheet of recording paper to a finisher is disposed to perform the sorting operation such that the sheet of paper is conveyed from a conveying path for forming an image in an image forming body section of a front operating type in a direction approximately perpendicular to this image forming conveying path. Accordingly, it is possible to make compact the entire image forming apparatus including the body section thereof and the finisher. Therefore, it is not necessary to set a large space required to operate the general image forming apparatus and disposed around the apparatus. Therefore, the space for operating the image forming apparatus can be greatly reduced so that the image forming apparatus can be arranged in a small space.

In addition to this, in accordance with the present invention, paper conveying speeds in the forward conveying path and a conveying path perpendicular thereto are set from the width h and the distance i having a most strict conveying condition with respect to the sheet of recording paper such that the distance between preceding and subsequent sheets of recording paper in the forward conveying path is larger than a predetermined distance. Accordingly, the preceding sheet of recording paper does not overlap the subsequent sheet of recording paper in an inlet portion of the perpendicular conveying path. This paper overlapping state can be reliably prevented by a simplified structure irrespective of any paper size. Accordingly, the sheets of paper can be preferably conveyed stably at a high speed and the paper conveying mechanism can be cheaply manufactured.

Further, in accordance with the present invention, a switch back conveying path is set in the conveying path in the image forming body section when a two-sided (double-sided) copying operation is performed with respect to a sheet of recording paper having a small size. Accordingly, it is possible to reduce a conveying time for resupplying the sheet of paper to perform the two-sided copying operation with respect to the sheet of recording paper having a small size, thereby improving copying efficiency.

Further, in accordance with the present invention, the sheet of recording paper is turned upside down in the conveying path of the sheet of recording paper including the perpendicular conveying path. Accordingly, it is possible to arrange the sheet of recording paper in a page order in accordance with an original.

Many widely different embodiments of the present invention may be constructed without departing from the spirit and scope of the present invention. It should be understood that the present invention is not limited to the specific embodiments described in the specification, except as defined in the appended claims.

What is claimed is:

1. A paper conveying mechanism in an image forming apparatus, comprising;

an image forming body section of a front operating type provided with a forward conveying path for conveying a discharged sheet of recording paper having an image formed thereon toward a direction of front and rear sides of the image forming apparatus;

after-treatment means for after-treating the sheet of recording paper and arranged in parallel to a side portion of the image forming body section;

a perpendicular conveying path connected with the forward conveying path for conveying the sheet of recording paper discharged from the forward conveying path toward a direction approximately perpendicular to the forward conveying path in a horizontal face of the sheet of recording paper, thereby to feed the sheet of recording paper to said after-treatment means;

first feeding means for feeding the sheet of recording paper in said forward conveying path;

second feeding means for feeding the sheet of recording paper in said perpendicular conveying path; and a switching means connected with both of said first feeding means and said second feeding means for switching selectively an operation and a stop of feeding of the sheet of recording paper by said first feeding means or said second feeding means.

2. A paper conveying mechanism as claimed in claim 1, wherein said after-treatment means is constructed by a finisher.

3. A paper conveying mechanism in an image forming apparatus, comprising:

an image forming body section of a front operating type provided with a forward conveying path for conveying a discharged sheet of recording paper having an image formed thereon toward a direction of front and rear sides of the image forming apparatus;

after-treatment means for after-treating the sheet of recording paper and arranged in parallel to a side portion of the image forming body section;

a perpendicular conveying path connected with the forward conveying path for conveying the sheet of recording paper discharged from the forward conveying path toward a direction approximately perpendicular to the forward conveying path in a horizontal face of the sheet of recorded paper, thereby to feed the sheet of recording paper to said after-treatment means;

first feeding means for feeding the sheet of recording paper in said forward conveying path;

second feeding means for feeding the sheet of recording paper in said perpendicular conveying path; and a switching means connected with both of said first feeding means and said second feeding means for switching selectively an operation and a stop of feeding of the sheet of recording paper by said first feeding means or said second feeding means, said first feeding means including means for selecting either a paper conveying speed $V_1$ equal to said image forming process speed or a paper conveying speed $V_2$ set to be higher than said image forming process speed by providing a constant relation therebetween.

4. A paper conveying mechanism as claimed in claim 3, wherein said paper feeding means in the forward conveying means further comprises means for setting the paper conveying speed by using, as a reference, the sheet of recording paper having a largest value with respect to a difference (h−i) between a width h of the sheet of recording paper with respect to a conveying direction thereof and a distance i between sheets of recording paper.

5. A paper conveying mechanism in an image forming apparatus, comprising:

an image forming body section of a front operating type provided with a forward conveying path for conveying a discharged sheet of recording paper toward a direction of front and rear sides of the image forming apparatus at a predetermined feed speed, said sheet of recording paper having an image thereon formed at a predetermined image forming process speed;

after-treatment means for after-treating the sheet of recording paper and arranged in parallel to a side portion of the image forming body section;

a perpendicular conveying path connected with the forward conveying path for conveying the sheet of recording paper discharged from said forward conveying path toward a direction approximately perpendicular to the forward conveying path in a horizontal face of the sheet of recording paper, thereby to feed the sheet of recording paper to said after-treatment means;

first feeding means for feeding the sheet of recording paper in said forward conveying path;

means for selecting either a paper conveying speed $V_1$ equal to said image forming process speed or a paper-conveying speed $V_2$ set to be higher than said image forming process speed by providing a constant relation therebetween, said selecting means being disposed in the first feeding means in the forward conveying path; and means for setting the paper conveying speed by using, as a reference, the sheet of recording paper having a largest value with respect to a difference (h−i) between a width h of the sheet of recording paper with respect to a conveying direction thereof and a distance i between sheets of recording paper, said setting means being disposed in the first feeding means in the forward conveying path.

6. A paper conveying mechanism as claimed in claim 5, wherein said after-treatment means is constructed by a finisher.

7. A paper conveying mechanism as claimed in claim 5, wherein the paper feeding means in the forward conveying path is constructed to set the paper conveying speed by a signal indicative of the detection of a rear end of the sheet of recording paper immediately after the sheet of recording paper has been discharged from a fixing device.

8. A paper conveying mechanism as claimed in claim 5, wherein the paper feeding means in the forward conveying path is constructed to provide said paper conveying path $V_1$ and said paper conveying mechanism further comprises paper feeding means for feeding the sheet of recording paper in the perpendicular conveying path and providing said paper conveying speed $V_2$.

9. A paper conveying mechanism as claimed in claim 5, wherein the paper feeding means in the forward conveying path is constructed to set the paper conveying speed every paper size on the basis of the width h and the distance i with respect to the sheet of recording paper.

10. A paper conveying mechanism in an image forming apparatus, comprising:

a conveying-circulating path for conveying and circulating a sheet of recording paper in a conveying direction set from a front side to a rear side with respect to an operation face of a copying machine;

discharging ports for discharging the sheet of recording paper and respectively disposed on an upper side of said copying machine in said conveying-circulating path and on one side of the copying machine corresponding to a direction perpendicular to said conveying direction in a horizontal face of the sheet of recording paper;

a first switch back conveying path for a small paper size located just behind the fixing device on a downstream side thereof in said conveying direction in said conveying-circulating path, said first switch back conveying path being separated from said discharging port on the upper side of the copying machine and setting a conveying path toward a paper resupplying device for a two-sided copy;

a second switch back conveying path for a large paper size located on a downstream side of the first switch back conveying path in said conveying-circulating path, said second switch back conveying path being branched from a discharging path toward the discharging port on the upper side of the copying machine and setting a conveying path toward said paper resupplying device for a two-sided copy;

a synthesis conveying path for a synthetic copy branched from the discharging path toward the discharging port on the upper side of the copying machine and setting a conveying path toward said paper resupplying device for a two-sided copy; and a perpendicular conveying path branched from the second switch back conveying path and synthesis conveying path, for changing the conveying direction of the sheet of recording paper in a direction perpendicular to said conveying direction in a position different from that of the paper resupplying device for a two-sided copy in a horizontal face of the sheet of recording paper.

11. A paper conveying mechanism in an image forming apparatus, comprising:

a conveying circulating path for conveying and circulating a sheet of recording paper in a conveying direction set from a front side to a rear side with respect to an operation face of a copying machine;

discharging ports for discharging the sheet of recording paper and respectively disposed on an upper side of said copying machine in said conveying-circulating path and on one side of the copying machine corresponding to a direction perpendicular to said conveying direction in a horizontal face of the sheet of recording paper to said conveying direction;

a first switch back conveying path for a small paper size located just behind the fixing device on a downstream side thereof in said conveying direction in said conveying-circulating path, said switch back conveying path for a small paper size being separated from said discharging port on the upper side of the copying machine and setting a conveying path toward a paper resupplying device for a two-sided copy;

a second switch back conveying path for a larger paper size located on a downstream side of the first switch back conveying path in said conveying-circulating path, said second switch back conveying path being branched from a discharging path toward the discharging port on the upper side of the copying machine and setting a conveying path toward said paper resupplying device for a two-sided copy;

a synthesis conveying path for a synthetic copy branched from the discharging path toward the discharging port on the upper side of the copying machine and setting a conveying path toward said paper resupplying device for a two-sided copy; and a perpendicular conveying path branched from the second switching back conveying path and synthesis conveying path, for changing the conveying direction of the sheet of recording paper in a direction perpendicular to said conveying direction in a position different from that of the paper resupplying device for a two-sided copy in a horizontal face of the sheet of recording paper, a conveying speed $V_1$ of the sheet of recording paper at the time of an image transfer processing on a photosensitive body for forming an image thereon in the conveying path from the front side to the rear side with respect to said operation face is set to be less than a conveying speed $V_2$ of the sheet of recording paper at the time of a copying processing except for the image transfer processing.

12. A paper conveying mechanism as claimed in claim 10, wherein said mechanism further comprises a reverse receiving section located on an extension of said perpendicular conveying path and receiving the sheet of recording paper in a state in which the conveying direction of the sheet of recording paper conveyed from said perpendicular conveying path is changed so as to switch upper and lower sides of an image face on the received sheet of paper.

* * * * *